US011332940B2

(12) United States Patent
Charles et al.

(10) Patent No.: US 11,332,940 B2
(45) Date of Patent: May 17, 2022

(54) MOVEABLE STAIR SYSTEMS AND METHODS

(71) Applicant: EMEH, INC., Lebanon, NJ (US)

(72) Inventors: Bryan I. Charles, Muncy, PA (US); Roger W. Barr, Williamsport, PA (US); Kevin Wayne Smith, Hughesville, PA (US); Anthony J. Peachey, Muncy, PA (US); Timothy A. Fisher, Montoursville, PA (US); Harold Dale Mathias, Watsontown, PA (US); Justin Eugene Moon, Montgomery, PA (US); Gabriel Patrick Blasi, Montgomery, PA (US); Robert James Belvin, Williamsport, PA (US); Charles S. Sawyer, Mifflinburg, PA (US)

(73) Assignee: EMEH, INC., Lebanon, NJ (US)

( * ) Notice: Subject to any disclaimer, the term of this patent is extended or adjusted under 35 U.S.C. 154(b) by 0 days.

(21) Appl. No.: 17/192,288

(22) Filed: Mar. 4, 2021

(65) Prior Publication Data

US 2021/0189734 A1 Jun. 24, 2021

Related U.S. Application Data

(62) Division of application No. 16/612,800, filed as application No. PCT/US2018/029697 on Apr. 27, 2018, now Pat. No. 10,968,636.

(Continued)

(51) Int. Cl.

| | |
|---|---|
| ***E04F 11/06*** | (2006.01) |
| ***E04B 1/98*** | (2006.01) |
| ***E04F 11/02*** | (2006.01) |

(52) U.S. Cl.

CPC ..... *E04F 11/062* (2013.01); *E04B 1/98* (2013.01); *E04F 2011/0203* (2013.01)

(58) Field of Classification Search

CPC ..... E04F 11/062; E04F 2011/0203; E04F 11/022; E04B 1/98

See application file for complete search history.

(56) References Cited

U.S. PATENT DOCUMENTS 2,220,155 A ‡ 11/1940 Jachim ..... E04F 11/062 182/1
3,299,590 A ‡ 1/1967 Carter ..... E04F 11/0255 52/183

(Continued)

FOREIGN PATENT DOCUMENTS

CN 103397754 A ‡ 11/2013
CN 204983437 U ‡ 1/2016

(Continued)

OTHER PUBLICATIONS

U.S. Appl. No. 16/612,800, dated Mar. 2, 2021, Issue Fee Payment.

(Continued)

*Primary Examiner* — Rodney Mintz
(74) *Attorney, Agent, or Firm* — Baker Botts L.L.P.

(57) ABSTRACT

The present disclosure relates to stair systems and methods for allowing stair movement between building levels while maintaining the structural integrity of the stair system for safe egress passage. The systems and methods of the present disclosure allow for independent movement of the surrounding building walls, landings, floor slabs, and/or any other portion of the surrounding building structure or stair system. The embodiments of the present disclosure are suitable for use in both new constructions as well as in existing constructions for retrofit applications to allow for movement between levels, landings, or within stairwell structures. The present disclosure reduces stair damage during building movement whether it is from wind, thermal, or seismic activity, and/or any other type of suitable force or experience, as the present disclosure allows for directional move- (Continued)

ment, or a combination thereof, including tension and compression, lateral, or vertical movement.

20 Claims, 25 Drawing Sheets

Related U.S. Application Data

(60) Provisional application No. 62/506,255, filed on May 15, 2017.

(56) References Cited

U.S. PATENT DOCUMENTS 3,626,438 A ‡ 12/1971 Cornell ..... E04F 11/0255 52/183
3,691,712 A ‡ 9/1972 Bowling ..... E04B 1/98 52/393
3,693,754 A ‡ 9/1972 Butler ..... E04F 11/062 182/86
3,912,298 A ‡ 10/1975 Humphrey ..... B60R 3/02 280/166
3,946,833 A ‡ 3/1976 Riehlmann ..... E06C 9/08 182/20
3,997,026 A ‡ 12/1976 Riehlmann ..... E06C 1/125 182/96
4,039,050 A ‡ 8/1977 Bowling ..... E04B 1/98 188/268
4,347,638 A ‡ 9/1982 Weaver ..... B60R 3/02 14/71.1
4,642,953 A ‡ 2/1987 DeGood ..... E04F 11/06 52/183
4,768,617 A ‡ 9/1988 Mason ..... B64F 1/315 182/1
4,959,935 A ‡ 10/1990 Stob ..... E01D 15/24 182/156
4,971,168 A ‡ 11/1990 Stanescu ..... B63B 27/14 182/1
5,189,854 A ‡ 3/1993 Nebel ..... B63B 27/14 182/1
5,941,342 A ‡ 8/1999 Lee ..... B60R 3/02 182/95
6,003,270 A ‡ 12/1999 MacIntyre ..... E04H 3/126 52/10
6,527,081 B1 ‡ 3/2003 Tyner ..... E04F 11/1834 182/1
6,923,140 B1 ‡ 8/2005 Cook ..... E01D 15/24 114/362
7,866,443 B2 ‡ 1/2011 Truckner ..... E04F 11/0255 182/228.1
7,967,110 B2 ‡ 6/2011 Parker ..... E04F 11/068 182/77
9,290,947 B2 * 3/2016 Meier ..... E04B 2/56
9,683,372 B2 ‡ 6/2017 Meier ..... E04F 11/0223
9,758,981 B2 ‡ 9/2017 Charles ..... E04F 11/022
9,869,084 B2 ‡ 1/2018 Charles ..... E04H 9/021
10,584,480 B2 ‡ 3/2020 Charles ..... E04B 1/36
10,640,983 B2 ‡ 5/2020 Honeycutt ..... E04F 11/025
10,745,919 B1 ‡ 8/2020 Houston ..... E04B 1/2403
10,968,636 B2 * 4/2021 Charles ..... E04F 11/062
2002/0088669 A1 ‡ 7/2002 Truckner ..... E04F 11/1817 182/228.1
2005/0160688 A1 ‡ 7/2005 Truckner ..... E04G 13/06 52/182
2008/0023269 A1 ‡ 1/2008 Parker ..... E06C 9/08 182/195
2008/0190049 A1 ‡ 8/2008 Muti ..... E04G 27/00 52/183
2010/0293875 A1 ‡ 11/2010 Preston ..... E04F 11/022 52/183
2011/0162303 A1 ‡ 7/2011 Truckner ..... E04G 13/062 52/183
2015/0252568 A1 ‡ 9/2015 Pivetta ..... E04F 19/00 52/188
2015/0284962 A1 * 10/2015 Meier ..... E04B 2/56 52/184
2016/0102461 A1 ‡ 4/2016 Charles ..... E04H 9/021 52/183
2016/0201334 A1 ‡ 7/2016 Meier ..... E04F 11/022 52/184
2016/0215496 A1 ‡ 7/2016 Charles ..... E04F 11/022
2017/0275888 A1 ‡ 9/2017 Honeycutt ..... E04G 27/00
2018/0100301 A1 ‡ 4/2018 Charles ..... E04H 9/021
2020/0149284 A1 * 5/2020 Charles ..... E04F 11/022
2020/0199881 A1 ‡ 6/2020 Bianchi ..... E04F 11/062
2021/0115658 A1 * 4/2021 Peachy ..... E04F 11/022

FOREIGN PATENT DOCUMENTS

EP 2 754 765 A1 ‡ 7/2014
JP H 09-235908 A 9/1997
WO WO 2013/172806 A2 ‡ 11/2013

OTHER PUBLICATIONS

U.S. Appl. No. 16/612,800, dated Dec. 2, 2020, Notice of Allowance.
U.S. Appl. No. 16/612,800, dated Oct. 14, 2020, Response to Restriction Requirement.
U.S. Appl. No. 16/612,800, dated Aug. 14, 2020, Restriction Requirement.
Extended European Search Report dated Jan. 27, 2021 in Application No. EP 18801690.
International Search Report dated Sep. 26, 2018 in International Application No. PCT/US2018/029697.

* cited by examiner
‡ imported from a related application

MOVEABLE STAIR SYSTEMS AND METHODS

CROSS-REFERENCE TO RELATED APPLICATIONS

This application is a divisional of U.S. patent application Ser. No. 16/612,800, filed on Nov. 12, 2019, which is a U.S. National Stage Patent Application under 35 U.S.C. § 371 of International Application No. PCT/US2018/029697, filed on Apr. 27, 2018, which claims priority to U.S. Provisional Application Ser. No. 62/506,255, filed on May 15, 2017, the contents of each of which are incorporated by reference herein in their entirety.

BACKGROUND

Field

Embodiments of the present disclosure generally relate to the field of stair systems and methods. More specifically, embodiments provided herein relate to moveable stairs, including expansion joint systems and methods, for allowing directional and/or differential movements between levels and within stair structures to provide safe egress, enhance rescue, and/or reduce damage during movement.

Description of the Related Art

In multi-level buildings and structures stairs are essential to not only providing a means for moving about the levels but also for providing safe egress out of the structure in the event of an emergency. As such, stair safety is a constant concern as taller buildings continue to be constructed of new and more efficient materials and in various locations around the globe. The construction and installation of stairs create a necessary exit path that is regulated by various building codes which oftentimes require the stairs to survive fire and structural damage such that occupants can safely exit the building during a state of emergency.

Conventional stair assemblies, however, are rigidly connected to a landing or building structure rather than dynamically connected to a landing or building structure. As such, typical stair assemblies do not allow for sufficient movement in the event of building motion (e.g., during a seismic event). Rigid stairs create a force that must be accounted for in the building design. Furthermore, due to the interstory drift that occurs during building motion, rigidly connected stair systems can cause damage to any of the surrounding structure, the area below the stair system, and/or the stair system itself. Rigid stairs can disconnect, crumble, fail, and/or fall during building motion, which prohibits occupants from safely exiting, delays rescue operations, and threatens safety. Any damage to and/or collapse of the stair system immediately eliminates a means of egress from the building and places the occupants therein in additional danger during or after a building motion event and/or emergency.

Thus, stair safety and installation can increase building safety and reduce the effects of building motion. Therefore, what is needed in the art is a moveable stair system and method. More specifically, what is needed is a stair expansion system and method which allows for multidirectional movement and orbital capacity to absorb landing displacement without damage to the stairs.

SUMMARY

The present disclosure relates to stair systems and methods for allowing stair movement between building levels while maintaining the structural integrity of the stair system for safe egress passage. The systems and methods of the present disclosure allow for independent movement of the surrounding building walls, landings, floor slabs, and/or any other portion of the surrounding building structure or stair system. The embodiments of the present disclosure are suitable for use in both new constructions as well as in existing constructions for retrofit applications to allow for movement between levels, landings, or within stairwell structures. The present disclosure can reduce stair damage during building movement whether it is from wind, thermal, or seismic activity, and/or any other type of suitable force or experience, as the present disclosure allows for directional movement, or a combination thereof, including tension and compression, lateral, or vertical movement.

The purpose and advantages of the disclosed subject matter will be set forth in and apparent from the description that follows, as well as will be learned by practice of the disclosed subject matter. Additional advantages of the disclosed subject matter will be realized and attained by the systems and method particularly pointed out in the written description and claims hereof, as well as from the appended drawings.

To achieve the above and other advantages and in accordance with the purpose of the disclosed subject matter, as embodied and broadly described, the disclosed subject matter includes stair systems and methods. In some example embodiments, the stair system includes a first connector, a sliding body, an upper connector, a lower connector, and a second connector. The sliding body is operatively connected with the first connector. The sliding body includes a first end and a second end, and the second end is opposite the first end. The upper connector is operatively connected with the sliding body. The upper connector is operatively connected and telescopically disposed within the lower connector. The second connector is operatively connected with the lower connector at a first connection point.

In some embodiments, the first connector includes a first body. The first body can have a base for connection with a stair or landing, a first arm, and a second arm. Each of the first arm and the second arm can extend outward from the base. In some embodiments, the sliding body is cylindrical. In some embodiments, a first length between the first end of the sliding body and the second end of the sliding body is greater than a second length between the first arm of the first body and the second arm of the first body. In some embodiments, the upper connector is operatively connected with the sliding body at an approximate midpoint of the sliding body. In some embodiments, the sliding body extends through each of the first arm and the second arm such that the first arm and the second arm support the sliding body. In some embodiments, the upper connector is operatively coupled with the sliding body between the first arm and the second arm. In some embodiments, each of the first arm and the second arm include a circular cut-out therethrough allowing sliding movement and rotational movement of the sliding body therein. In some embodiments, the stair system can further include a first restriction body operatively disposed through each of the upper connector and the lower connector. In some embodiments, the first restriction body is a pin. In some embodiments, the upper connector includes a first slot therethrough and the lower connector includes a second slot therethrough. In some embodiments, the pin can be disposed through each of the first slot and the second slot to allow for telescopic movement of the upper connector with respect to the lower connector. In some embodiments, the second connector can include a shoe and a mounting portion connected with the shoe. In some embodiments, the first connector can be a landing connector and the second connector can be a stair connector. In some embodiments, the stair system can further include a pad coupled with the second connector. The pad can include a low friction material. The pad can be configured to be disposed between the second connector and a stair support. In some embodiments, the stair system can further include a pad disposed between the upper connector and the lower connector. In some embodiments, the pad can include a low friction material. In some embodiments, the sliding body can be configured for movement in a first lateral direction along a longitudinal axis of the sliding body and rolling movement about the longitudinal axis of the sliding body. In some embodiments, the lower connector can be configured for rotational movement about the first connection point. In some embodiments, the lower connector and the second connector can be configured for movement relative to the upper connector in a second lateral direction perpendicular to the first lateral direction.

In other example embodiments, a retrofit system for stairs is disclosed. The retrofit system includes a support angle, a rail, and a bracket. The support angle includes a horizontal panel and a vertical panel. The support angle is configured for connection to the stairs. The rail is disposed on the horizontal panel, and the bracket is configured for coupling with a tread of the stairs. The bracket is configured to at least partially form fit over a top of the rail such that the bracket allows for sliding movement of the stairs as guided by the rail.

In some embodiments, the positive connection assembly includes a nut and bolt assembly. In some embodiments, the bracket includes a first member and a second member that together form a U-shape. In some embodiments, the retrofit system for stairs can further include a top tread configured for disposal between a landing and the stairs to visually obstruct the support angle.

In further example embodiments, a stair system is disclosed. The stair system includes a first movement system and a second movement system. The first movement system includes a first landing connector, a first support beam, and a first connection system. The first landing connector includes a first guide rail and at least one first foot coupled with the first guide rail. The first support beam is operatively coupled with the first guide rail, such that the first support beam slides along the first guide rail. The first connection system couples the at least one first foot with at least one of a first stair, a first landing, or a first ground location. The second movement system includes a second landing connector, a second support beam, and a second connection system. The second landing connector includes a second guide rail and at least one second foot coupled with the second guide rail. The second support beam is operatively coupled with the second guide rail, such that the second support beam slides along the second guide rail. The second connection system couples the at least one second foot with at least one of a second stair, a second landing, or a second ground location. The first movement system allows for movement in a first direction and the second movement system allows for movement in a second direction perpendicular to the first direction. The first movement system is configured for coupling with a bottom landing of a first stair set and the second movement system is configured for coupling with a top landing of the first stair set.

In some embodiments, the stair system can further include a third movement system and a fourth movement system. In some embodiments, the third movement system can include a third landing connector, a third support beam, and a third connection system. In some embodiments, the third landing connector can include a third guide rail and at least one third foot coupled with the third guide rail. In some embodiments, the third support beam can be operatively coupled with the third guide rail, such that the third support beam slides along the third guide rail. In some embodiments, the third connection system can couple the at least one third foot with at least one of a third stair, a third landing, or a third ground location. In some embodiments, the fourth movement system can include a fourth landing connector, a fourth support beam, and a fourth connection system. In some embodiments, the fourth landing connector can include a fourth guide rail and at least one fourth foot coupled with the fourth guide rail. In some embodiments, the fourth support beam can be operatively coupled with the fourth guide rail, such that the fourth support beam slides along the fourth guide rail. In some embodiments, the fourth connection system can couple the at least one fourth foot with at least one of a fourth stair, a fourth landing, or a fourth ground location. In some embodiments, the third movement system can allow for movement in the second direction. In some embodiments, the fourth movement system can allow for movement in the first direction. In some embodiments, the third movement system is configured for coupling with the top landing of the first stair set and the fourth movement system is configured for coupling with a top landing of the second stair set.

It is to be understood that both the foregoing general description and the following detailed description are exemplary and are intended to provide further explanation of the disclosed subject matter claimed.

BRIEF DESCRIPTION OF THE DRAWINGS

So that the manner in which the above recited features of the present disclosure can be understood in detail, a more particular description of the disclosure, briefly summarized above, can be had by reference to embodiments, some of which are illustrated in the appended drawings. It is to be noted, however, that the appended drawings illustrate only exemplary embodiments and are therefore not to be considered limiting of its scope, and can admit to other equally effective embodiments.

FIG. 7I schematically illustrates an exemplary installation of multiple stair systems of any one of FIGS. 7A-7H, according to an example embodiment.

To facilitate understanding, identical reference numerals have been used to designate identical elements that are common to the figures. It is contemplated that elements and features of one embodiment can be beneficially incorporated in other embodiments without further recitation.

DETAILED DESCRIPTION

The present disclosure relates to stair systems and methods for allowing stair movement between building levels while maintaining the structural integrity of the stair system for safe egress passage. The systems and methods of the present disclosure allow for independent movement of the surrounding building walls, landings, floor slabs, and/or any other portion of the surrounding building structure or stair system. The embodiments of the present disclosure are suitable for use in both new constructions as well as in existing constructions for retrofit applications to allow for movement between levels, landings, or within stairwell structures. The present disclosure can reduce stair damage during building movement whether it is from wind, thermal, or seismic activity, and/or any other type of suitable force or experience, as the present disclosure allows for directional movement, or a combination thereof, including tension and compression, lateral, or vertical movement.

Figure 1B:
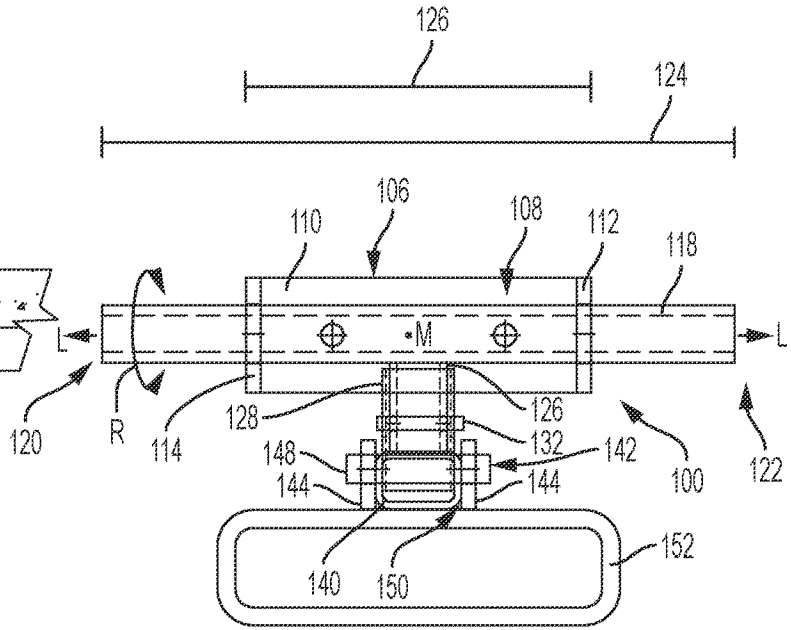
FIG. 1B schematically illustrates a front view of the stair system of FIG. 1A for allowing movement of stairs between building levels.
Figure 1A:
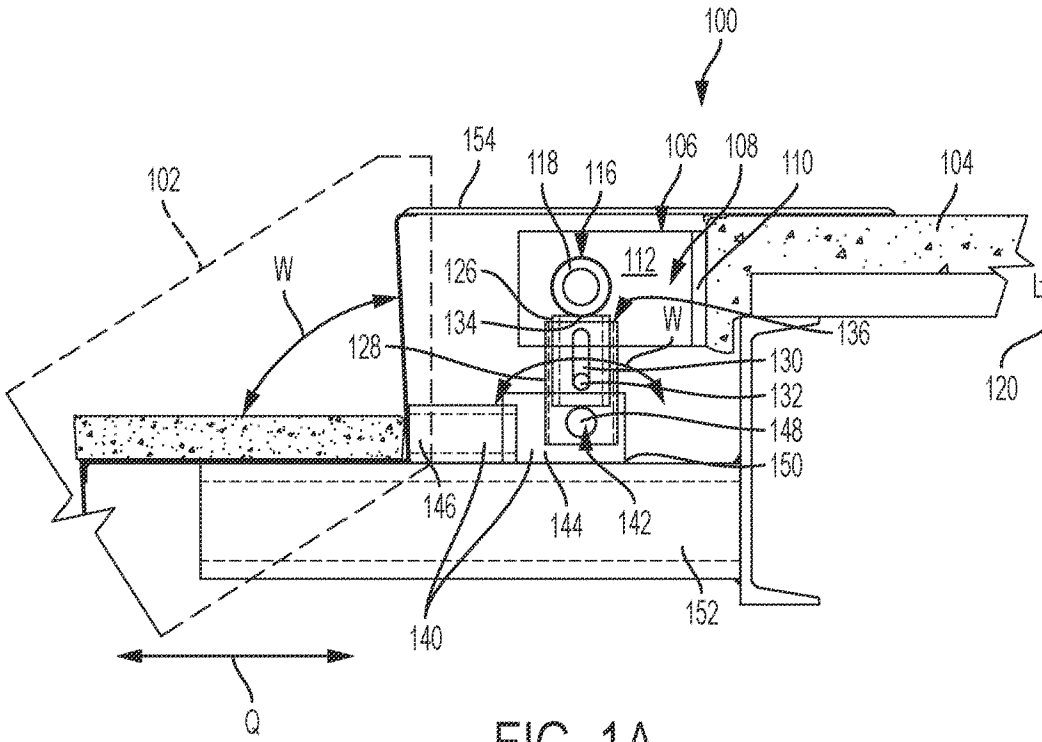
FIG. 1A schematically illustrates a side view of a stair system for allowing movement of stairs between building levels, according to an example embodiment.

Reference will now be made in detail to various exemplary embodiments of the disclosed subject matter, examples of which are illustrated in the accompanying drawings. The examples are not intended to limit the scope of the disclosed subject matter in any manner. The disclosed subject matter will be described in conjunction with the detailed description of the system. For purpose of illustration, and not limitation, FIGS. 1A and 1B schematically illustrate a stair system 100 for allowing for movement of stairs 102 between building levels in accordance with some embodiments of the disclosed subject matter. As shown, the stair system 100 includes a first connector 106. The first connector 106 is configured for coupling with a stair landing 104; however, in some embodiments, the first connector 106 can connect to or couple with an individual stair of stairs 102, the ground, and/or any other suitable connection structure. The first connector 106 includes a first body 108. The first body 108 includes a base 110, a first arm 112, and a second arm 114, as shown in FIG. 1B. Each of the first arm 112 and the second arm 114 extend outward from the base 110, in relatively the same direction. The first connector 106 can be coupled with, via the base 110, any of the structures described above via, for example, a nut and bolt connection, a welded connection, and/or any other suitable connection means. In some embodiments, other suitable connection means can include, but are not limited to, cast-in connections, embed connections, slotted nut and bolt connections, among others. In some embodiments, the base 110 and each of the first arm 112 and the second arm 114 can have a square or rectangular shape. Each of the first arm 112 and the second arm 114 have a cutout 116 to allow for the insertion of a body therein or therethrough. In some embodiments, the cutout 116 may be circular in shape, while in other embodiments, the cutout 116 may have any suitable shape.

The stair system 100 can also include a sliding body 118. The sliding body 118 has a first end 120 and a second end 122, wherein the second end 122 is opposite the first end 120. In some embodiments, the sliding body 118 is cylindrical, although other suitable shapes are contemplated. As described above, the shape of each cutout 116 can match the shape of the sliding body 118, such that the sliding body 118 can be inserted into and/or through each cutout 116. In some embodiments, the sliding body 118 is operatively connected with the first connector 106. As shown in FIG. 1A and FIG. 1B, the sliding body 118 extends through each cutout 116 of the first arm 112 and the second arm 114, such that the first arm 112 and the second arm 114 support the sliding body 118, thus allowing for sliding movement and rotational movement of the sliding body 118 therein. As such, the sliding body 118 can move freely within the first connector 106. In some embodiments, the sliding body 118 can be modified in order to increase friction for more control via, by way of example only, roughened finishes, ridges, grooves, abrasive materials, fuse-links, springs, changes in geometry, among other suitable modifications and/or techniques. Furthermore, as shown in FIG. 1B, a first length 124 between the first end 120 of the sliding body 118 and the second end 122 of the sliding body 118 is greater than a second length 124 between the first arm 112 of the first body 108 and the second arm 114 of the first body 108. The sliding body 118 is therefore configured for movement in first and second lateral directions L along a longitudinal axis of the sliding body 118 and for rotational movement R about the longitudinal axis of the sliding body 118. Furthermore, the first connector 106 is operatively connected to the sliding body 118 which allows the sliding body 118 to rotate and maintain orientation within the first connector 106 as the stairs 102 move in tension and/or compression, and/or toward and away from the stair landing 104, as described in more detail below.

In some embodiments, the stair system 100 also includes an upper connector 126. The upper connector 126 is operatively connected with the sliding body 118, such that the upper connector 126 and the sliding body 118 move in unison. In some embodiments, the upper connector 126 can be operatively connected with the sliding body 118 via, for example, a welded connection, a pinned connection, a threaded connection, a bolted connection, or any other suitable connection means. In some embodiments, the upper connector 126 is operatively connected with the sliding body 118 at an approximate midpoint M of the sliding body 118. In some embodiments, the upper connector 126 is operatively connected with the sliding body 118 between the first arm 112 of the first body 108 and the second arm 114 of the first body 108. The movement of the sliding body 118 in the first and second lateral directions L is limited by the distance from the upper connector 126 to either the first arm 112 or the second arm 114.

The stair system 100 can further include a lower connector 128. For example, the upper connector 126 is operatively connected and telescopically disposed within the lower connector 128. As such, the upper connector 126 slides within the lower connector 128. In some embodiments, the upper connector 126 can fit within the lower connector 128, such the upper connector 126 can be extended into and out of lower connector 128. It is contemplated, however, that in some embodiments, the lower connector 128 can be operatively connected and telescopically disposed within the upper connector 126. Other telescoping connections between the upper connector 126 and the lower connector 128 are also contemplated.

In some embodiments, each of the upper connector 126 and the lower connector 128 have one or more slots 130 formed at least partially through like sides of the upper connector 126 and the lower connector 128, such that the slots 130 of each of the upper connector 126 and the lower connector 128 at least partially overlap. For example, the slots 130 can extend the along a longitudinal axis of the upper connector 126 and the lower connector 128, such as, in the direction of the telescoping movement of the upper connector 126. The slots 130 can be sized to allow for the operative disposal of a first restriction body 132 therethrough. In some embodiments, the first restriction body 132 is operatively disposed through each of the upper connector 126 and the lower connector 128, to prohibit the upper connector 126 from disconnecting with the lower connector 128 during the telescoping movement. The first restriction body 132 is disposed through each slot 130 to allow for telescopic movement of the upper connector with respect to the lower connector 128. As such, the first restriction body 132 controls the upper connector 126 as the outer surface 134 of the upper connector 126 moves along the inner surface 136 of the lower connector 128. The first restriction body 132 is restrained by the slots 130 in the lower connector 128. In some embodiments, the first restriction body 132 is configured to provide between about 1 inch and about 10 inches of movement, for example, between about 1 inch and about 5 inches of movement. In some embodiments, the first restriction body 132 is a pin. In other embodiments, the first restriction body 132 can include a bolt and nut, a rod, a welded pin, a cotter pin, an extruded component, or any other suitable restrictor or component.

In some embodiments, a pad 138 is disposed between the upper connector 126 and the lower connector 128. In some embodiments, the pad 138 is coupled to the outer surface 134 of the upper connector 126, while in other embodiments, the pad 138 is coupled to the inner surface 136 of the lower connector 128. The pad 138 can include a low friction material, such as, by way of example only, PTFE, HDPE, polished stainless steel, or other suitable materials. The low friction material encourages free movement and/or reduces the friction between the upper connector 126 and the lower connector 128, thus allowing for smoother telescoping motion of the upper connector 126 within the lower connector 128, or vice versa.

The stair system 100 can further include a second connector 140. The second connector 140 is operatively connected with the lower connector 128 at a first connection point 142. In some embodiments, the second connector 140 includes a shoe 144 and a mounting portion 146. In some embodiments, the lower connector 128 includes at least one hole disposed therethrough for connecting with the second connector 140. Likewise, in some embodiments, the second connector 140 or the shoe 144 includes at least one hole disposed therethrough for connecting with the lower connector 128. The second connector 140 or the shoe 144 of the second connector 140 can operatively connect with the lower connector 128 at the first connection point 142 via a second restriction body 148. In some embodiments, the second restriction body 148 can be a pin, a bolt, a rod, or any other suitable connection body. The second restriction body 148 allows the lower connector 128 to rotate or move relative to the second connector 140 about the first connection point 142. As such, the lower connector 128 is configured for rotational movement W about the first connection point 142. Furthermore, the lower connector 128 and the second connector 140 are configured for movement relative to the upper connector 126 in third and fourth lateral directions Q, perpendicular to the first and second lateral directions L. Therefore, the lower connector 128 rotates on the second restriction body 148 while maintaining the vertical orientation of the second connector 140 and the stairs 102 during movement.

In some embodiments, the second connector 140 is configured for coupling with stair landing 104, an individual stair of stairs 102, the ground, and/or any other suitable connection structure. To facilitate and/or encourage free movement of the second connector 140, a pad 150, similar to pad 138, can be coupled with the second connector 140. The pad 150 can include a low friction material, such as, by way of example only, PTFE, HDPE, polished stainless steel, or other suitable material. The pad 150 is configured to be disposed between the second connector 140 and a stair support 152. In some embodiments, the second connector 140 and/or the stairs 102 can rest on the stair support 152. The stair support provides stability for stairs 102 to function during all movements and normal (static) operation.

In some embodiments, the stair system 100 further includes a cover plate 154. In some embodiments, the cover plate 154 is operatively connected with the stair system 100 or portion thereof, while in other embodiments the cover plate 154 is operatively connected with the stairs 102, and in other embodiments the cover plate 154 is a separate system. The cover plate 154 is configured to cover a gap and/or the stair system 100 between the stairs 102 and any of a landing, ground, or other system. The cover plate 154 is therefore configured to slide in any lateral direction (e.g., forward/backward and/or side-to-side), raise, and/or lower as the stairs 102 move in order to provide a continuous, gap-less, path. The cover plate 154 can be, for example, a metal sheet or plate, an extruded plate, an expansion joint cover system, or any other suitable covering.

As shown in FIG. 1A for illustration and not limitation, the first connector 106 is a landing connector and the second connector 140 is a stair connector. It is contemplated, however, that, although the first connector 106 as shown in FIG. 1A is operatively connected with the stair landing 104 (i.e., a landing connector), the first connector 106, in some embodiments, can be operatively connected with the stairs 102 (i.e., a stair connector) or the stair support 152. Similarly, it is contemplated that, although the second connector 140 as shown in FIG. 1A is operatively connected with stair support 152, the second connector 140, in some embodiments, can be operatively connected with the stair landing 104 (i.e., a landing connector) or the stairs 102. As such, the stair system 100 can be utilized in conjunction with a fixed or alternative connection at either a top end or a bottom end of a stair.

Figure 1C:
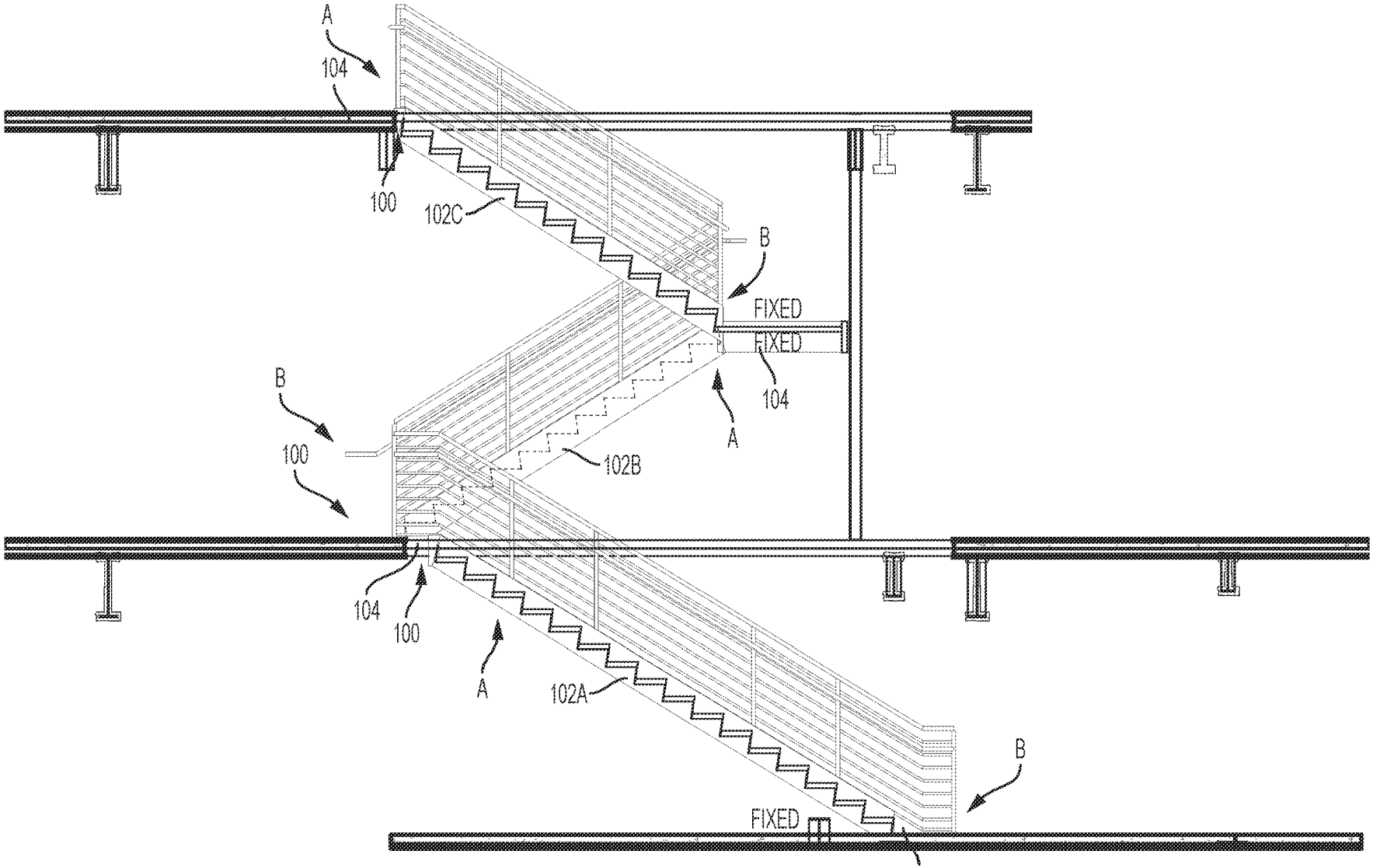
FIG. 1C schematically illustrates a side view of a multi-level stair set with a plurality of stair systems, according to an example embodiment.

For propose of illustration and not limitation, FIG. 1C schematically illustrates an example multilevel stair set on which a plurality of stair systems 100 have been installed. As shown, each set of stairs 102 is operatively connected with a stair landing 104 at both a top end A of each set of stairs 102 and a bottom end B of each set of stairs 102. However, as discussed above, each set of stairs 102, in some embodiments, can be operatively connected with its respective landing at either the top end A or the bottom B of each set of stairs 102. The opposite end of each set of stairs 102 can then be fixed to the opposing landing. To illustrate with reference to FIG. 1C, the bottom end B of the first stairs 102A is fixed to its respective lower landing. The top end A of the first stairs 102A is then operatively connected with its respective upper landing via a first embodiment of stair system 100. The bottom end B of the second stairs 102B is also operatively connected with its respective lower landing (which is the same as the upper landing of the first stairs 102A) via a second embodiment of stair system 100. The top end A of the second stairs 102B is then fixed to its respective upper landing. The bottom end B of the third stair set 102C is also fixed to its respective lower landing (which is the same as the upper landing of the second stairs 102B). The top end A of the third stairs 102C is then operatively connected with its respective upper landing via a third embodiment of stair system 100.

Figure 2A:
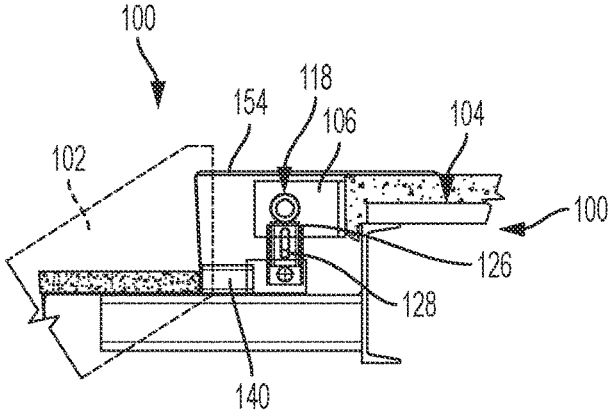
FIG. 2A schematically illustrates a side view of a stair system in a nominal, resting position, according to an example embodiment.
Figure 2D:
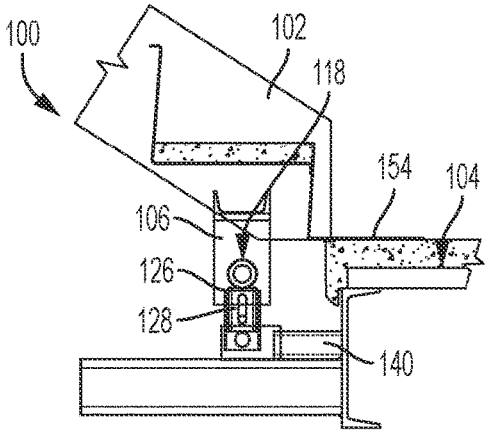
FIG. 2D schematically illustrates a side view of a stair system in a nominal, resting position, according to an example embodiment.
Figure 2B:
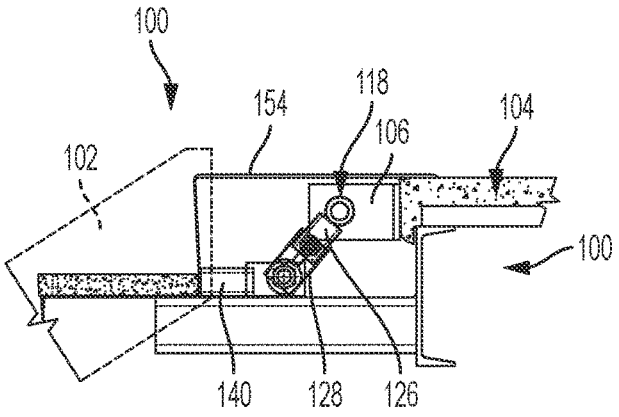
FIG. 2B schematically illustrates a side view of the stair system of FIG. 2A in a tension position.
Figure 2E:
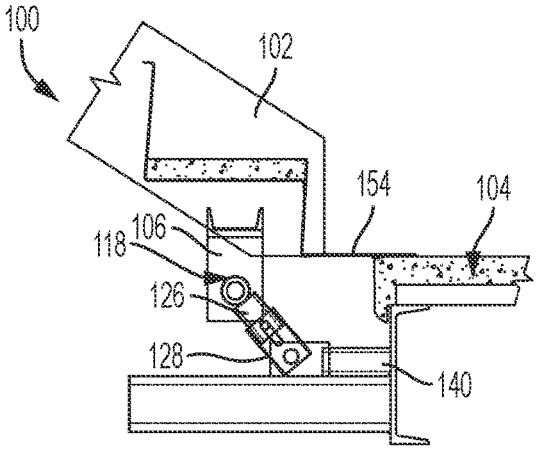
FIG. 2E schematically illustrates a side view of the stair system of FIG. 2D in a tension position.
Figure 2C:
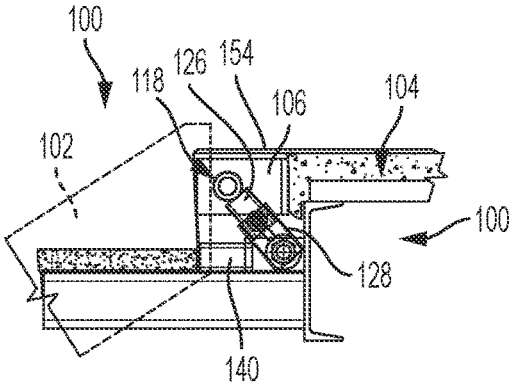
FIG. 2C schematically illustrates a side view of the stair system of FIG. 2A in a compression position.

FIGS. 2A-2C schematically illustrate the range of movement and positioning of the stair system 100 in a first connection scheme in accordance with some embodiments. As shown in each of FIGS. 2A-2C, the first connector 106 of the stair system 100 is operatively connected with the stair landing 104 and the second connector 140 of the stair system 100 is operatively connected with the stairs 102. FIG. 2A illustrates the stair system 100 in a nominal position with the upper connector 126 and the lower connector 128 in a non-extended, non-telescoped downward position. The sliding body 118 is in a non-rotated state, and the second connector 140 has experienced no lateral movement. The cover plate 154 of FIG. 2A is also in a nominal position, covering a gap having a size of AA. For purposes of illustration only, and not intended to be limiting, a gap having size A is smaller than a gap having size AA, and a gap having size AAA is larger than a gap having size AA. As shown, FIG. 2B illustrates the stair system 100 of FIG. 2A in a tension position with the upper connector 126 and the lower connector 128 being in an extended, telescoped position. The sliding body 118 is in a positively-rotated state, and the second connector 140 has experienced lateral movement away from the stair landing. The cover plate 154 of FIG. 2B is also in a tension position, covering a gap having a size of AAA. As shown, FIG. 2C illustrates the stair system 100 of FIG. 2A in a compression position with the upper connector 126 and the lower connector 128 being in a compressed, telescoped position. The sliding body 118 is in a negatively-rotated state, and the second connector 140 has experienced lateral movement toward the stair landing. The cover plate 154 of FIG. 2C is also in a compression position, covering a gap having a size of A. In any of FIGS. 2A, 2B, or 2C the stair system 100 can also experience side-to-side lateral movement via the sliding motion of the sliding body 118.

Figure 2F:
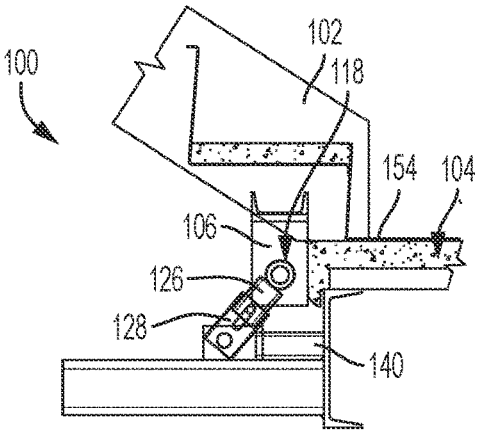
FIG. 2F schematically illustrates a side view of the stair system of FIG. 2D in a compression position.

FIGS. 2D-2F schematically illustrate the range of movement and positioning of the stair system 100 in a second connection scheme. As shown in each of FIGS. 2D-2E, the first connector 106 of the stair system 100 is operatively connected with the stairs 102 and the second connector 140 of the stair system 100 is operatively connected with the stair landing 104. FIG. 2D illustrates the stair system 100 in a nominal position with the upper connector 126 and the lower connector 128 in a non-extended, non-telescoped upward position. The sliding body 118 is in a non-rotated state, and the second connector 140 has experienced no lateral movement. The cover plate 154 of FIG. 2D is also in a nominal position, covering a gap having a size of AA. For purposes of illustration only, and not intended to be limiting, a gap having size A is smaller than a gap having size AA, and a gap having size AAA is larger than a gap having size AA. As shown, FIG. 2E illustrates the stair system 100 of FIG. 2D in a tension position with the upper connector 126 and the lower connector 128 being in an extended, telescoped position. The sliding body 118 is in a positively-rotated state, and the stair 102 and supports 106 has experienced lateral movement away from the stair landing. The cover plate 154 of FIG. 2E is also in a tension position, covering a gap having a size of AAA. As shown, FIG. 2F illustrates the stair system 100 of FIG. 2D in a compression position with the upper connector 125 and the lower connector 128 being in a compressed, telescoped position. The sliding body 118 is in a negatively-rotated state, and the stair 102 and supports 106 has experienced lateral movement toward the stair landing. The cover plate 154 of FIG. 2F is also in a compression position, covering a gap having a size of A. In any of FIGS. 2D, 2E, or 2F the stair system 100 can also experience side-to-side lateral movement via the sliding motion of the sliding body 118.

The movement of the stair system 100 described herein, including the telescopic movement, allows the stairs 102 to remain generally parallel to the ground (i.e., no tilt) when moving in tension and compression, thus allowing for safe egress. On the other hand, hypothetical stair systems which swing, tilt, and/or do not remain generally parallel to the ground during tension and compression have increased dangers during egress, as a user may lose balance and/or fall during an evacuation.

Figure 2G:
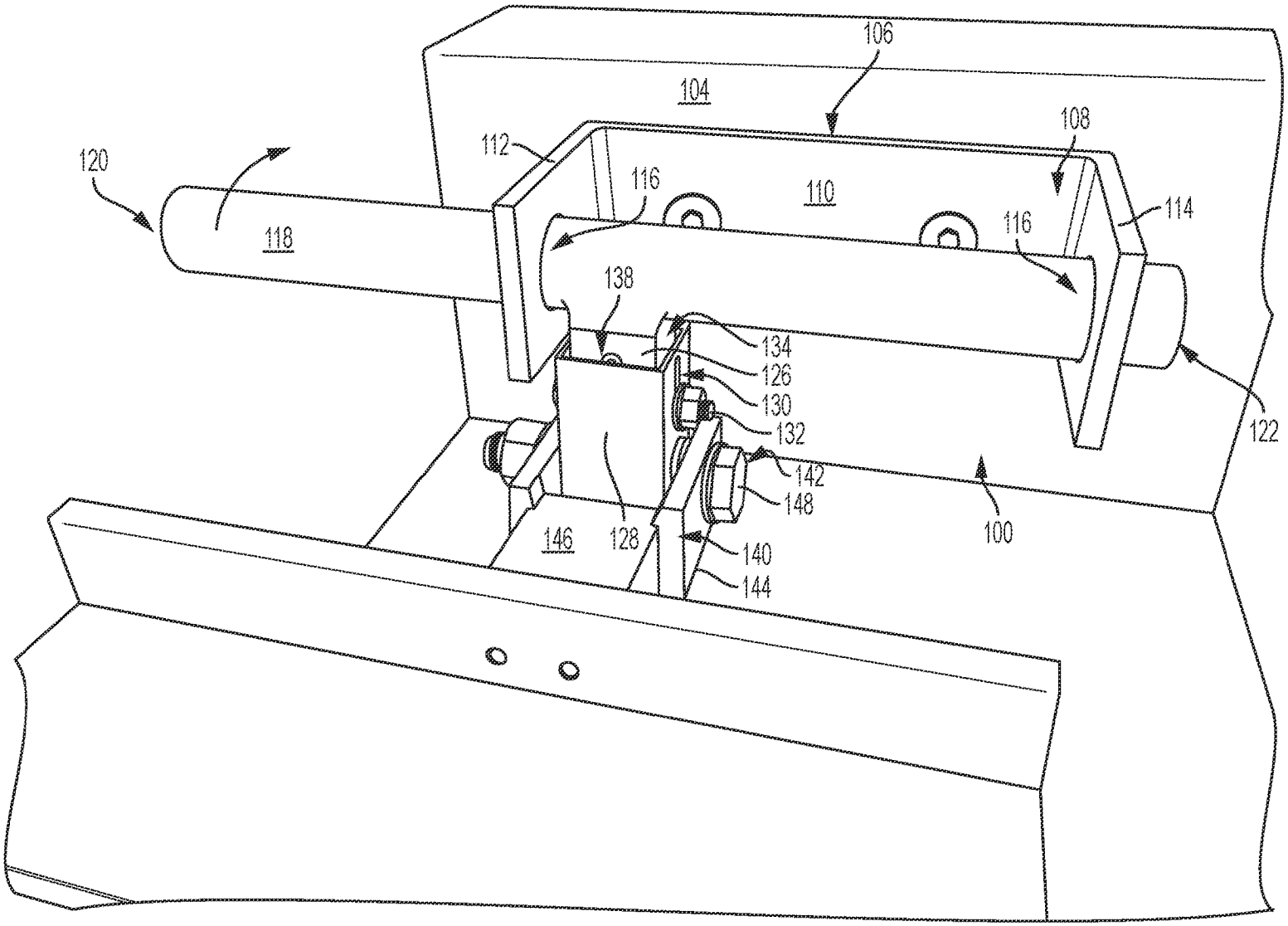
FIG. 2G schematically illustrates movement of the sliding body of a stair system in a first lateral direction, according to an example embodiment.
Figure 2H:
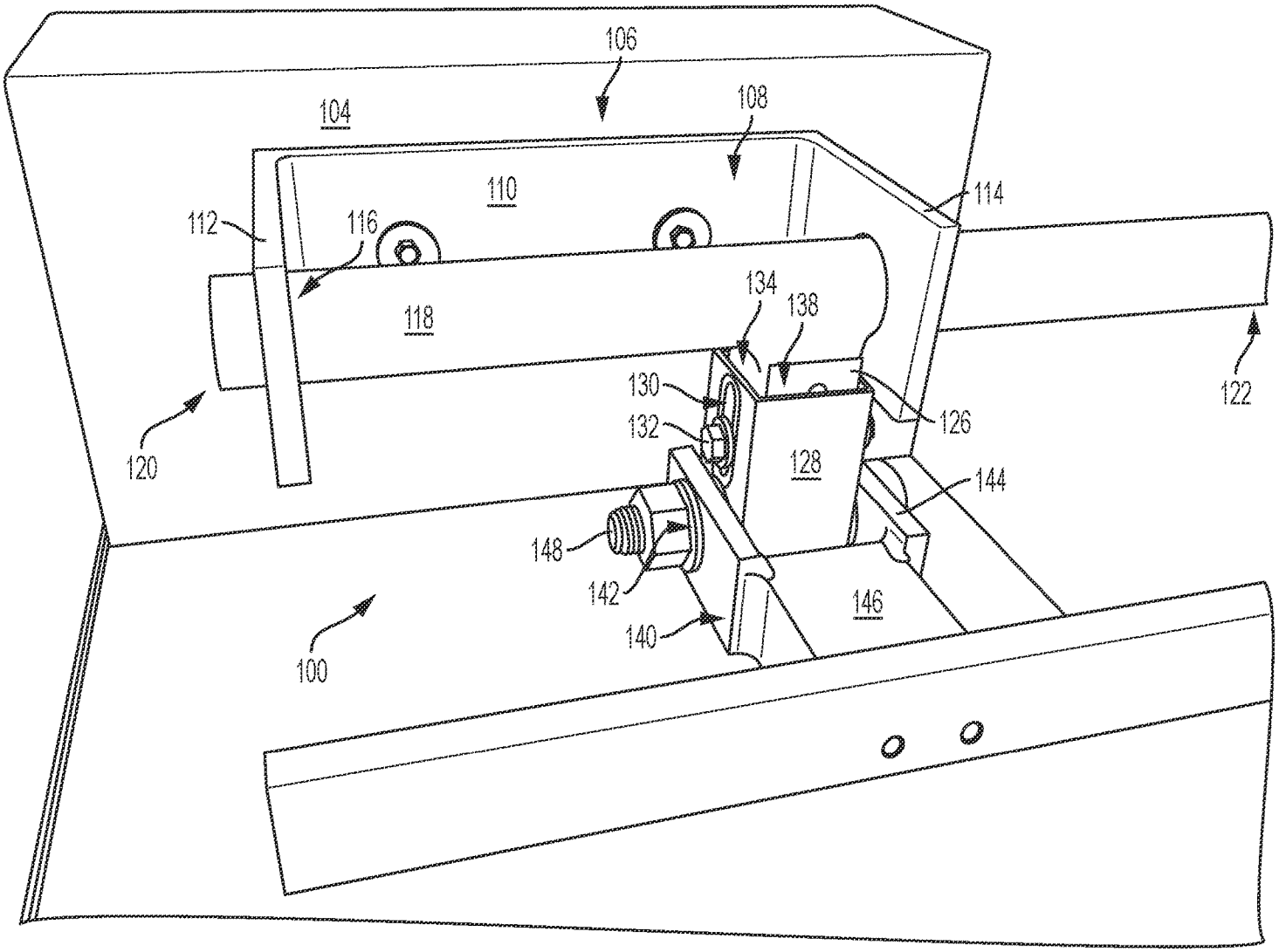
FIG. 2H schematically illustrates movement of the sliding body of the stair system of FIG. 2G in a second lateral direction.

FIGS. 2G and 2H schematically illustrate movement of the sliding body 118 in the first and second lateral directions L. As shown in FIG. 2G, the sliding body 118 of the stair system 100 is positioned in a first negative lateral direction such that the upper connector 126, the lower connector 128, and the second connector 140 are disposed toward and adjacent the first arm 112. As shown in FIG. 2H, the sliding body 118 of the stair system 100 is positioned in a second positive lateral direction such that the upper connector 126, the lower connector 128, and the second connector 140 are disposed toward and adjacent the second arm 114.

Stair systems in accordance with the disclosed subject matter, including the stair system 100, are configured to permit multiaxial movement of stairs 102 between building levels and/or landings. Testing has been performed and results indicate that the stair system 100 safely allows for multidirectional movement between about 0.1 inch and about 10 inches, such as between about 1 inch and about 5 inches. It is contemplated, however, that the movement capabilities of the stair system 100 are defined by each specific building requirements, project requirements, and/or required clearances. As such, the specific movement requirements for each stair system 100 are able to be altered to meet the requirements and clearances as detailed above.

Benefits of stair systems in accordance with the disclosed subject matter include that the stair system 100 provides multidirectional movement and orbital capacity to absorb landing displacement without damage to the stair system, thus allowing for safe egress. Additionally, the stair system 100 is easily disposed at the top or bottom of a flight of stairs, thus allowing all movement to be located at one point (e.g., an intermediate landing) as opposed to requiring each axis of movement to be located at opposite ends of the flight. As such, one end of the flight of stairs can remain fixed yet still provide the benefits of multidirectional movement. Additionally, multidirectional movement in stairs reduces the risk of damage to adjacent architecture and structural components.

Figure 3B:
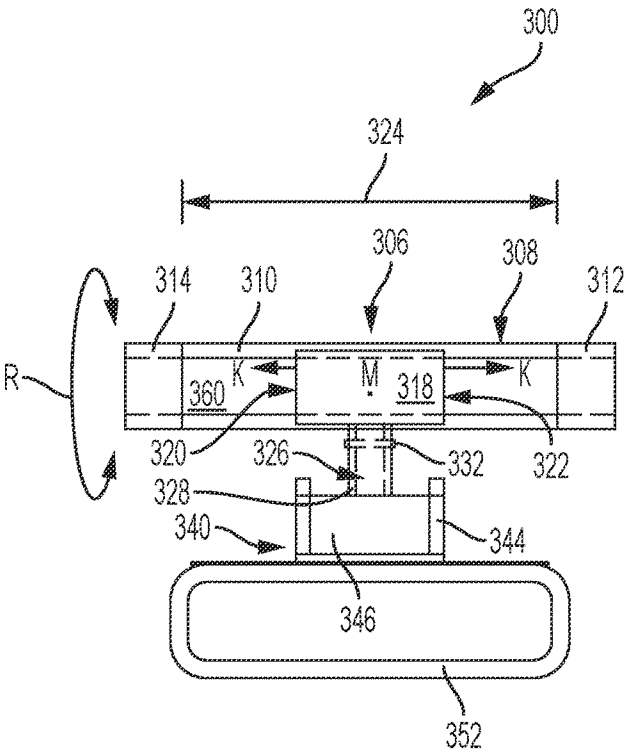
FIG. 3B schematically illustrates a front view of the stair system of FIG. 3A for allowing movement of stairs between building levels, according to an example embodiment.
Figure 3A:
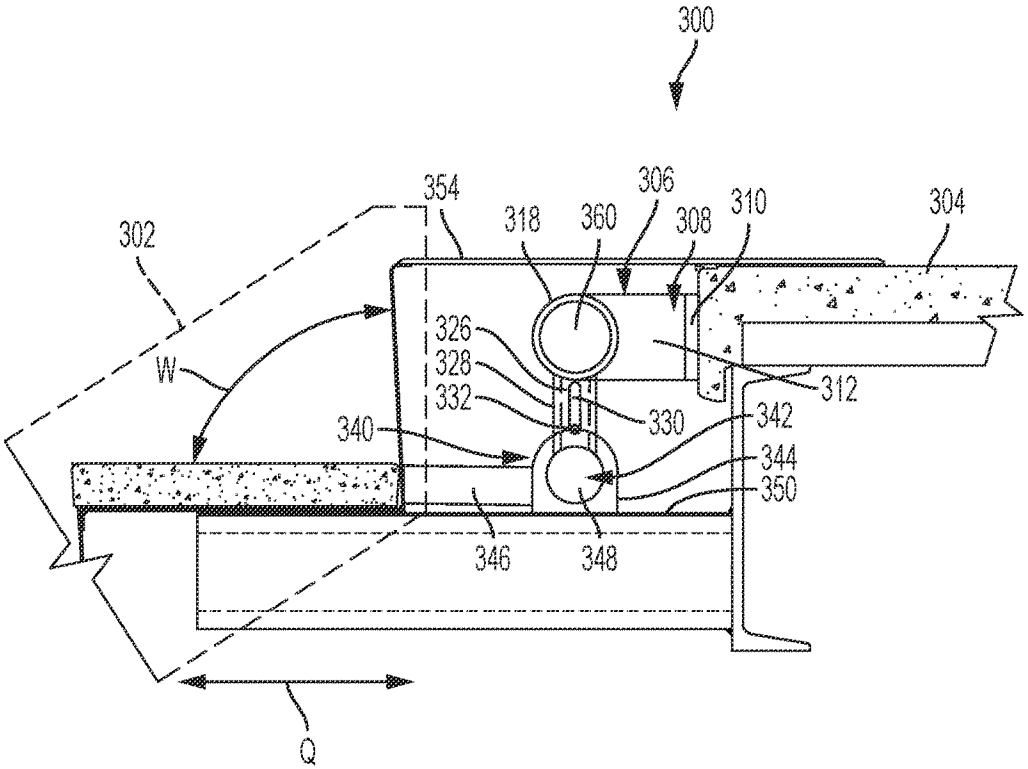
FIG. 3A schematically illustrates a side view of an alternative stair system for allowing movement of stairs between building levels, according to an example embodiment.

For the purpose of illustration and not limitation, FIGS. 3A and 3B schematically illustrate an alternative embodiment for a stair system 300 for allowing for movement of stairs 302 between building levels. Stair system 300 is similar to stair system 100, described above, with differences described below.

As shown in FIGS. 3A and 3B, the stair system 300 can include a first connector 306. The first connector 306 is configured for coupling with a stair landing 304; however, in some embodiments, the first connector 306 can connect to or couple with an individual stair of stairs 302, the ground, and/or any other suitable connection structure. The first connector 306 can include a first body 308. The first body 308 can include a base 310, a first arm 312, and a second arm 314. Each of the first arm 312 and the second arm 314 can extend outward from the base 310, in relatively the same direction. The first connector 306 can be coupled with, via the base 310, with any of the structures described above via, for example, a nut and bolt connection, a welded connection, a cast-in connection, an embed connection, a slotted nut and bolt connection, and/or any other suitable connection means. In some embodiments, the base 310 and each of the first arm 312 and the second arm 314 can have a square shape, a rectangular shape, a shape with rounded edges, or any other suitable shape. Each of the first arm 312 and the second arm 314 can have a cutout 316 to allow for the insertion of a body therein or therethrough. In some embodiments, the cutout 316 may be circular in shape, while in other embodiments, the cutout 316 may have any suitable shape.

The stair system 300 can also include an extension rod 360. The extension rod 360 can be disposed between each of the first arm 312 and the second arm 314. In some embodiments, the extension rod 360 is operatively connected with each cutout 316 of the first arm 312 and the second arm 314, such that the extension rod 360 is disposed at least partially within the first arm 312 and the second arm 314 and/or secured in place by the first arm 312 and the second arm 314. Furthermore, the extension rod 360 can be of any suitable shape, such as cylindrical as shown in FIG. 3A. The shape of each cutout 316 can match the shape of the extension rod 360.

The stair system 300 can also include a sliding body 318. The sliding body 318 has a first end 320 and a second end 322, wherein the second end 322 is opposite the first end 320. The sliding body 318 is configured such that the sliding body 318 is a rotating upper coupler. As such, the sliding body 318 is configured to fit over the extension rod 360. Therefore the sliding body 318 is of a similar shape as the extension rod 360 and size to fit about an exterior surface of the extension rod 360. In some embodiments, the sliding body 318 is cylindrical such that the sliding body 318 fits around a cylindrical extension rod 360, thus allowing for sliding movement and rotational movement of the sliding body 318 about the extension rod 360. As such, the sliding body 318 can move freely on the extension rod 360. Therefore, as shown in FIG. 3B, the moveable distance 324 of the sliding body 318 in the first lateral direction K is limited by the length of the extension rod 360 between the first arm 312 and the second arm 314. The sliding body 318 is therefore configured for movement in a first lateral direction K along a longitudinal axis of the extension rod 360 and for rolling movement R about the longitudinal axis of the extension rod 360. Furthermore, the extension rod 360 is operatively connected with the sliding body 318 which allows the sliding body 318 to rotate and maintain orientation as the stairs 302 move in tension and/or compression, and/or toward and away from the stair landing 304, as described in more detail below.

In some embodiments, the stair system 310 can also include an upper connector 326. The upper connector 326 is operatively connected with the sliding body 318, such that the upper connector 326 and the sliding body 318 move in unison. In some embodiments, the upper connector 326 can be operatively connected with the sliding body 318 via, for example, a welded connection, a pinned connection, a threaded connection, a bolted connection, an extruded component, or any other suitable connection means. In some embodiments, the upper connector 326 is operatively connected with the sliding body 318 at an approximate midpoint M of the sliding body 318.

The stair system 300 can further include a lower connector 328. For example, the upper connector 326 is operatively connected and telescopically disposed within the lower connector 328. As such, the upper connector 326 slides within the lower connector 328. In some embodiments, the upper connector 326 can fit within the lower connector 328, such that the upper connector 326 can be extended into and out of lower connector 328. It is contemplated, however, that in some embodiments, the lower connector 128 can be operatively connected and telescopically disposed within the upper connector 126. Other telescoping connections between the upper connector 126 and the lower connector 128 are also contemplated.

In some embodiments, each of the upper connector 326 and the lower connector 328 have one or more slots 330 formed at least partially through like sides of the upper connector 326 and the lower connector 328, such that the slots 330 of each of the upper connector 326 and the lower connector 328 at least partially overlap. For example, in some embodiments, the slots 330 can extend the along a longitudinal axis of the upper connector 326 and the lower connector 328, such as, in the direction of the telescoping movement of the upper connector 326. The slots 330 can be sized to allow for the operative disposal of a first restriction body 332 therethrough. In some embodiments, the first restriction body 332 is operatively disposed through each of the upper connector 326 and the lower connector 328, to prohibit the upper connector 326 from disconnecting with the lower connector 328 during the telescoping movement. The first restriction body 332 is disposed through each slot 330 to allow for telescopic movement of the upper connector with respect to the lower connector 328. As such, the first restriction body 332 controls the upper connector 326 as the outer surface 334 of the upper connector 326 moves along the inner surface 336 (not shown) of the lower connector 328. The first restriction body 332 is restrained by the slots 330 in the lower connector 328. In some embodiments, the first restriction body 332 is configured to provide between about 1 inch and about 10 inches of movement, for example, between about 1 inch and about 5 inches of movement. In some embodiments, the first restriction body 332 is a pin. In other embodiments, the first restriction body 332 can include a bolt and nut, a rod, a welded pin, a cotter pin, an extruded component, or any other suitable restrictor or component.

In some embodiments, a pad 338 is disposed between the upper connector 326 and the lower connector 328. In some embodiments, the pad 338 is coupled to the outer surface 334 of the upper connector 326, while in other embodiments, the pad 338 is coupled to the inner surface 336 of the lower connector 328. The pad 338 can include a low friction material, such as, by way of example only, PTFE, HDPE, polished stainless steel, or other suitable materials. The low friction material encourages free movement and/or reduces the friction between the upper connector 326 and the lower connector 328, thus allowing for smoother telescoping motion of the upper connector 326 within the lower connector 328.

The stair system 300 can further include a second connector 340. The second connector 340 is operatively connected with the lower connector 328 at a first connection point 342. In some embodiments, the second connector 340 includes a shoe 344 and a mounting portion 346. In some embodiments, the lower connector 328 includes at least one hole disposed therethrough for connecting with the second connector 340. Likewise, in some embodiments, the second connector 340 or the shoe 344 includes at least one hole disposed therethrough for connecting with the lower connector 328. The second connector 340 or the shoe 344 of the second connector 340 can operatively connect with the lower connector 328 at the first connection point 342 via a second restriction body 348. In some embodiments, the second restriction body 348 can be a pin, a bolt, a rod, or any other suitable connection body. The second restriction body 348 allows the lower connector 328 to rotate or move relative to the second connector 340 about the first connection point 342. As such, the lower connector 328 is configured for rotational movement W about the first connection point 342. Furthermore, the lower connector 328 and the second connector 340 are configured for movement relative to the upper connector 326 in a second lateral direction Q, perpendicular to the first lateral direction K. Therefore, the lower connector 328 rotates on the second restriction body 348 while maintaining the vertical orientation of the second connector 340 and the stairs 302 during movement.

In some embodiments, the second connector 340 is configured for coupling with stair landing 304, an individual stair of stairs 302, the ground, and/or any other suitable connection structure. To facilitate and/or encourage free movement of the second connector 340, a pad 350, similar to pad 338, can be coupled with the second connector 340. The pad 350 can include a low friction material, such as, by way of example only, PTFE, HDPE, polished stainless steel, or other suitable material. The pad 350 is configured to be disposed between the second connector 340 and a stair support 352. In some embodiments, the second connector 340 and/or the stairs 302 can rest on the stair support 352. The stair support provides stability for stairs 302 to function during all movements and normal (static) operation.

In some embodiments, the stair system 300 further includes a cover plate 354. In some embodiments, the cover plate 354 is operatively connected with the stair system 300 or portion thereof, while in other embodiments the cover plate 354 is operatively connected with the stairs 302, and in other embodiments the cover plate 354 is a separate system. The cover plate 354 is configured to cover a gap and/or the stair system 300 between the stairs 302 and any of a landing, ground, or other system. The cover plate 354 is therefore configured to slide in any lateral direction (e.g., forward/backward and/or side-to-side), raise, and/or lower as the stairs 302 move in order to provide a continuous, gap-less, path. The cover plate 354 can be, for example, a metal sheet or plate.

As shown in FIG. 3A, the first connector 306 is a landing connector and the second connector 340 is a stair connector. It is contemplated, however, that, although the first connector 306 as shown in FIG. 3A is operatively connected with the stair landing 304 (i.e., a landing connector), the first connector 306, in some embodiments, can be operatively connected with the stairs 302 (i.e., a stair connector) or the stair support 352. Similarly, it is contemplated that, although the second connector 340 as shown in FIG. 3A is operatively connected with stair support 352, the second connector 340, in some embodiments, can be operatively connected with the stair landing 304 (i.e., a landing connector) or the stairs 302. As such, the stair system 300 can be utilized in conjunction with a fixed or alternative connection at either a top end or a bottom end of a stair.

Figure 3C:
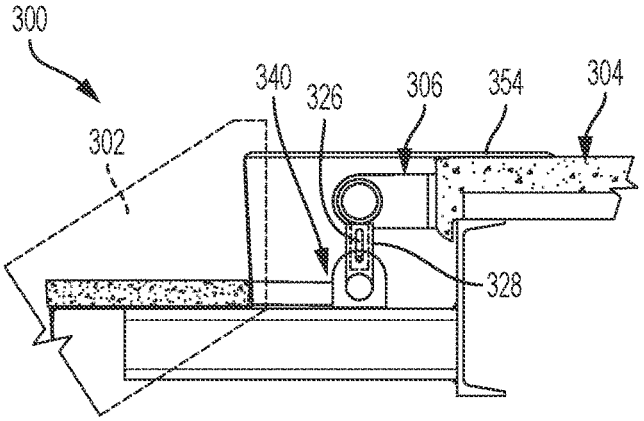
FIG. 3C schematically illustrates a side view of a stair system in a nominal, resting position, according to an example embodiment.
Figure 3F:
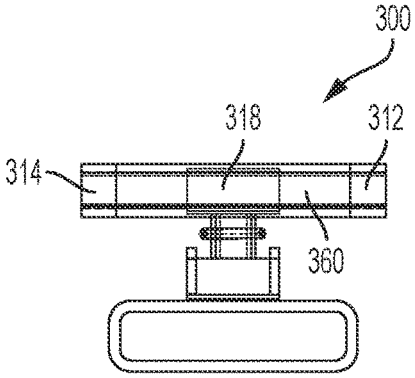
FIG. 3F schematically illustrates a front view of the stair system of FIG. 3A in a neutral position.
Figure 3D:
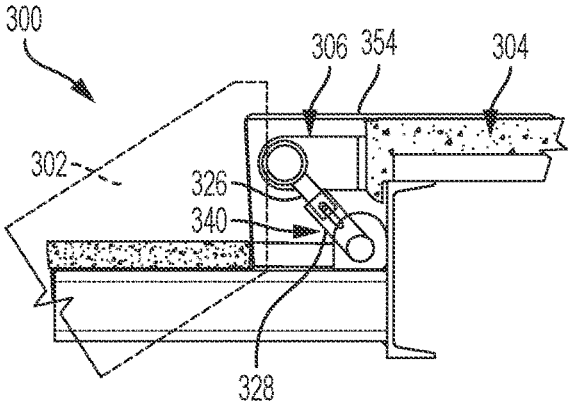
FIG. 3D schematically illustrates a side view of the stair system of FIG. 3A in a compression position.
Figure 3G:
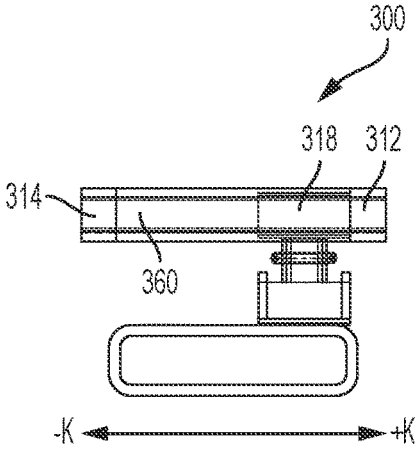
FIG. 3G schematically illustrates a front view of the stair system of FIG. 3A in a positive position.
Figure 3E:
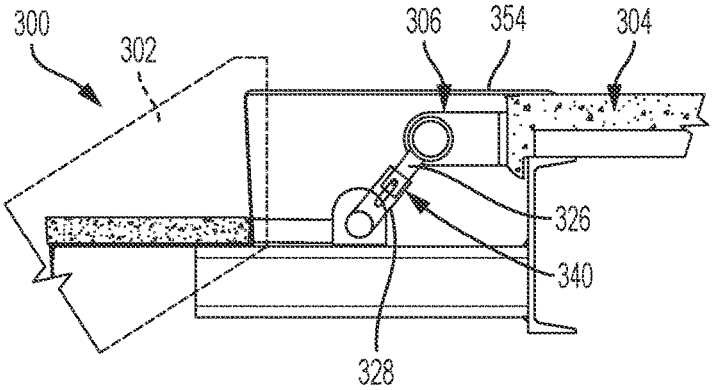
FIG. 3E schematically illustrates a side view of the stair system of FIG. 3A in a tension position.

FIGS. 3C-3E schematically illustrate the range of movement and positioning of the stair system 300 in a first connection scheme. As shown in each of FIGS. 3C-3E, the first connector 306 of the stair system 300 is operatively connected with the stair landing 304 and the second connector 340 of the stair system 300 is operatively connected with the stairs 302. FIG. 3C illustrates the stair system 300 in a nominal position with the upper connector 326 and the lower connector 328 in a non-extended, non-telescoped downward position. The sliding body 318 is in a non-rotated state, and the second connector 340 has experienced no lateral movement. The cover plate 354 of FIG. 3C is also in a nominal position, covering a gap having a size of AA. For purposes of illustration only, and not intended to be limiting, a gap having size A is smaller than a gap having size AA, and a gap having size AAA is larger than a gap having size AA. As shown, FIG. 3D illustrates the stair system 300 of FIG. 3C in a compression position with the upper connector 326 and the lower connector 328 being in a compressed, telescoped position. The sliding body 318 is in a negatively-rotated state, and the second connector 340 has experienced lateral movement toward the stair landing. The cover plate 354 of FIG. 3D is also in a compression position, covering a gap having a size of A.

As shown, FIG. 3E illustrates the stair system 300 of FIG. 3C in a tension position with the upper connector 326 and the lower connector 328 being in an extended, telescoped position. The sliding body 318 is in a positively-rotated state, and the second connector 340 has experienced lateral movement away from the stair landing. The cover plate 354 of FIG. 3E is also in a tension position, covering a gap having a size of AAA. In any of FIGS. 3C, 3D, or 3E the stair system 300 can also experience side-to-side lateral movement via the sliding motion of the sliding body 318.

The movement of the stair system 300 described herein, including the telescopic movement, allows the stairs 302 to remain generally parallel to the ground (i.e., no tilt) when moving in tension and compression, thus allowing for safe egress. On the other hand, hypothetical stair systems which swing, tilt, and/or do not remain generally parallel to the ground during tension and compression have increased dangers during egress, as a user may lose balance and/or fall during an evacuation.

Figure 3H:
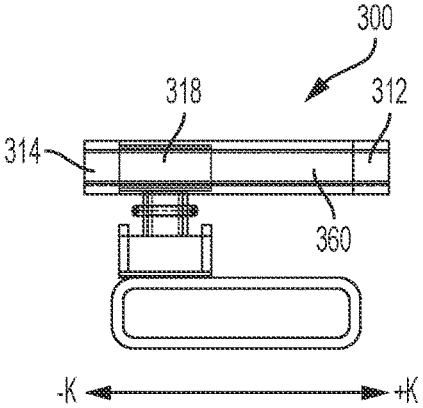
FIG. 3H schematically illustrates a front view of the stair system of FIG. 3A in a negative position.

FIGS. 3F-3H schematically illustrate the range of side-to-side lateral movement and positioning of the stair system 300 according to an example connection scheme. As shown, FIG. 3F illustrates the stair system 300 in a neutral centered position such that the sliding body 318 is disposed at the approximate midpoint of the extension rod 360.

As shown, FIG. 3G illustrates the stair system 300 in a positive position wherein the sliding body 318 is laterally moved in the +K direction, such that the sliding body 318 is disposed adjacent the first arm 312.

As shown, FIG. 3H illustrates the stair system 300 in a negative position wherein the sliding body 318 is laterally moved in the −K direction, such that the sliding body 318 is disposed adjacent the second arm 314.

The stair system 300 is configured to permit multiaxial movement of stairs 302 between building levels and/or landings. Testing has been performed and results indicate that the stair system 300 safely allows for multidirectional movement between about 0.1 inch and about 10 inches, such as between about 1 inch and about 5 inches. It is contemplated, however, that the movement capabilities of the stair system 300 are defined by each specific building requirements, project requirements, and/or required clearances. As such, the specific movement requirements for each stair system 300 are able to be altered to meet the requirements and clearances as detailed above.

Benefits of stair systems in accordance with the disclosed subject matter include that the stair system 300 provides multidirectional movement and orbital capacity to absorb landing displacement without damage to the stair system 300, thus allowing for safe egress. Additionally, the stair system 300 is easily disposed at the top or bottom of a flight of stairs, thus allowing all movement to be located at one point (e.g., an intermediate landing) as opposed to requiring each axis of movement to be located at opposite ends of the flight. As such, one end of the flight of stairs can remain fixed. Also, multidirectional movement in stairs reduces the risk of damage to adjacent architecture and/or structural components.

Figure 4A:
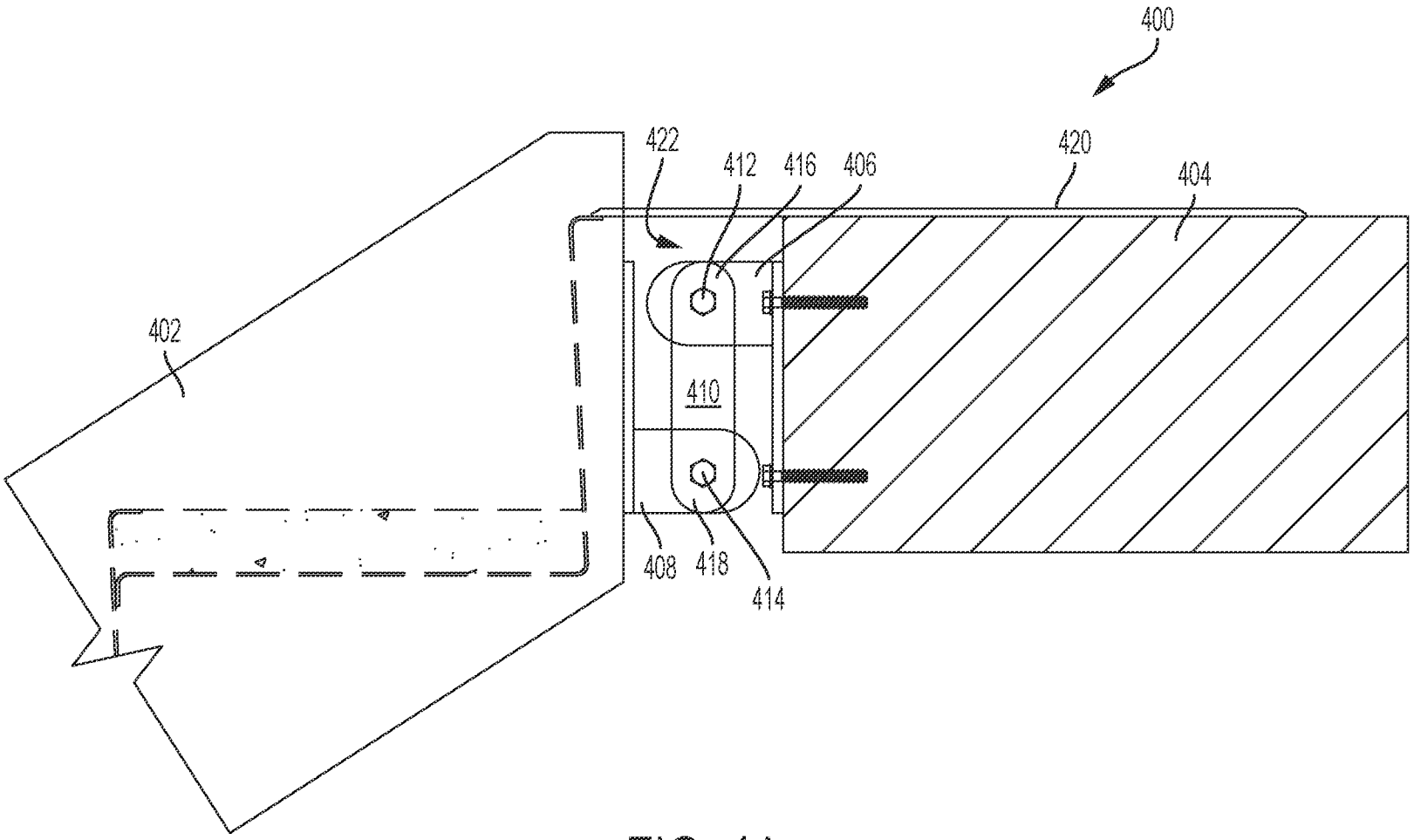
FIG. 4A schematically illustrates a side view of another stair system for allowing movement of stairs between building levels, according to an example embodiment.
Figure 4B:
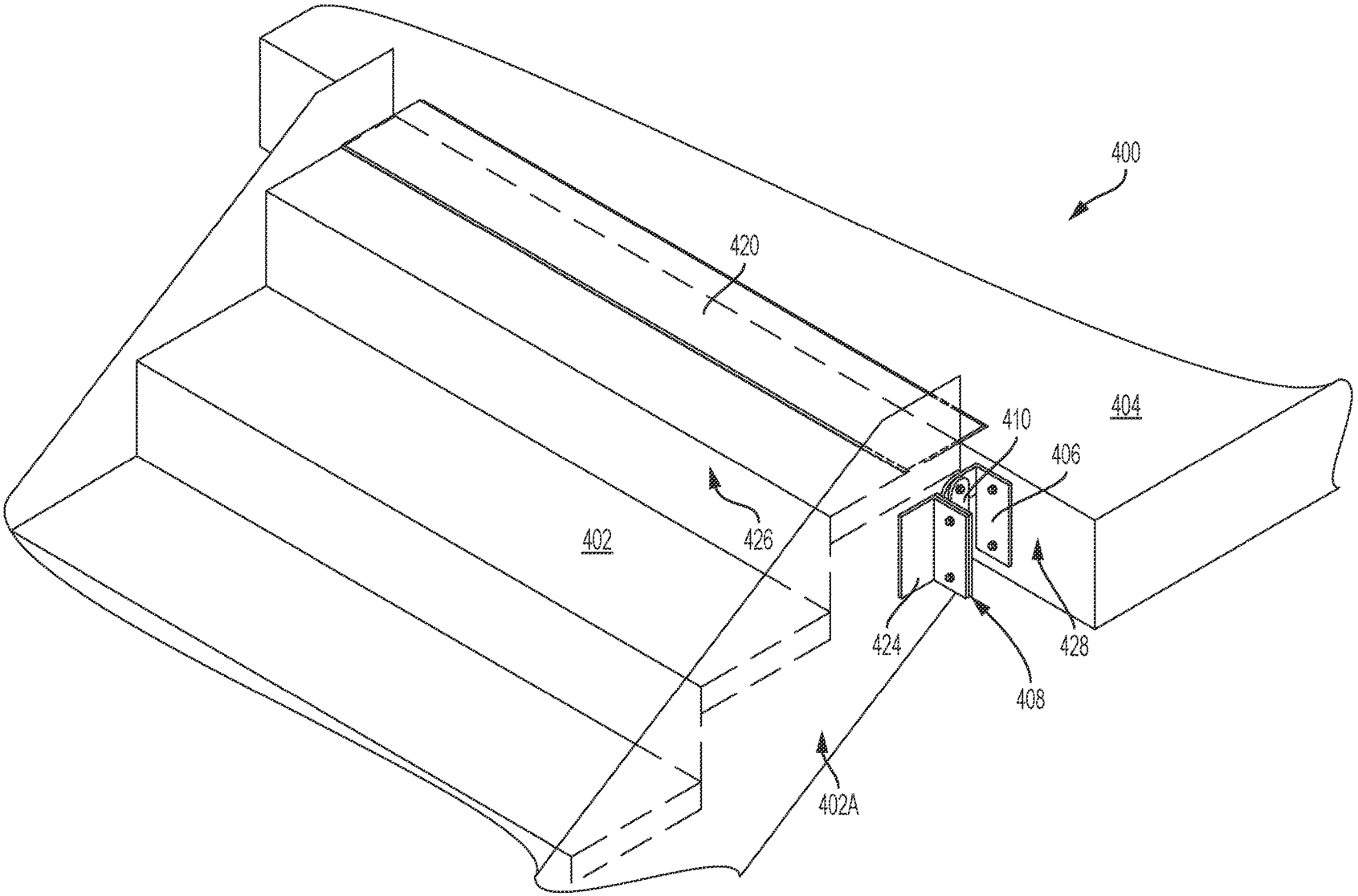
FIG. 4B schematically illustrates a perspective view of the stair system of FIG. 4A with an alternate attachment bracket, according to an example embodiment.
Figure 4C:
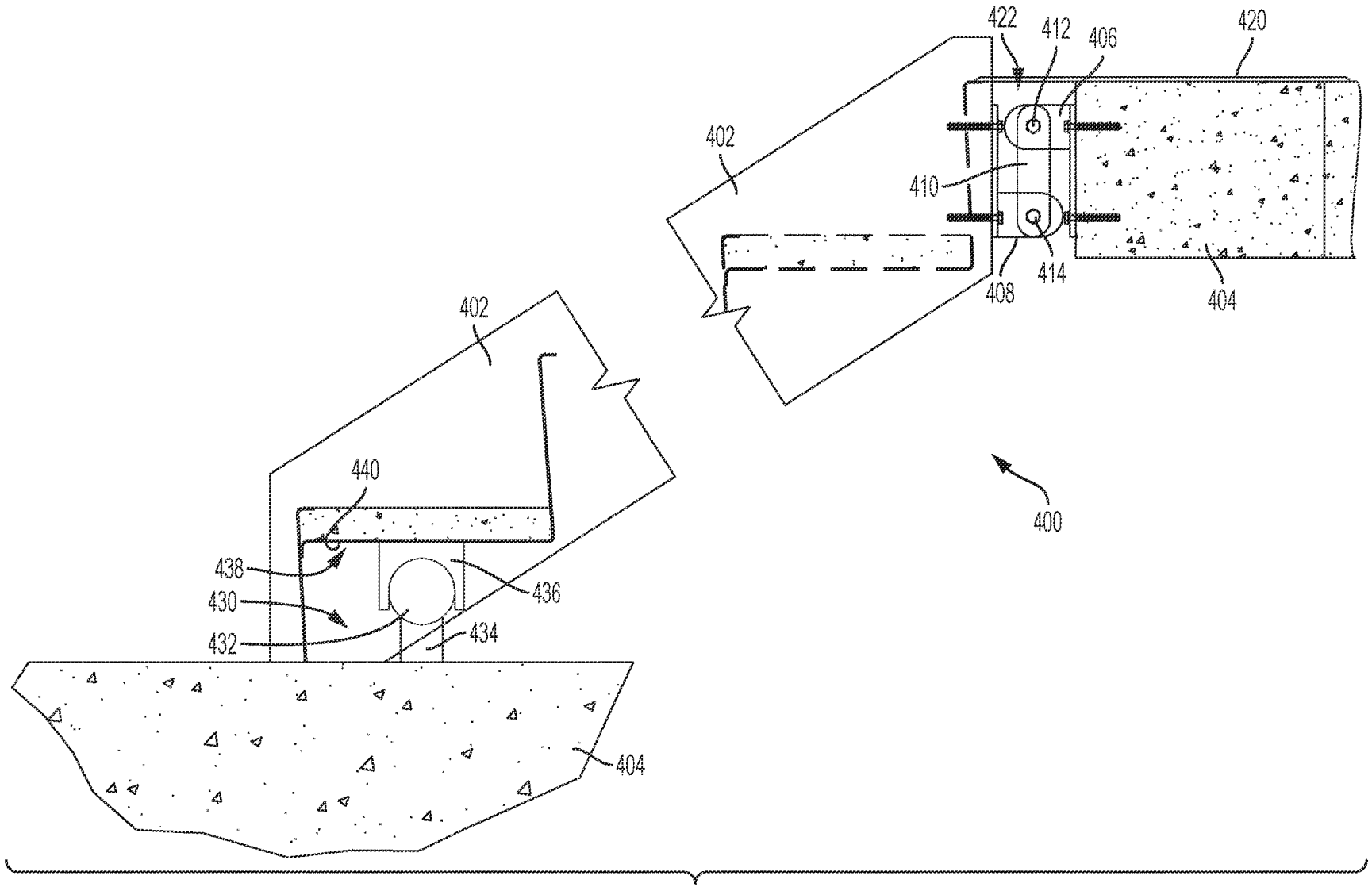
FIG. 4C schematically illustrates a side view of the stair system of FIG. 4A with a pin connection system, according to an example embodiment.

For purpose of illustration and not limitation, FIGS. 4A-4C schematically illustrate alternative embodiments for a stair system 400 for allowing for movement of stairs 402 between building levels. For example, as shown in FIG. 4A, the stair system 400 can include a first connector 406 and a second connector 408. In some embodiments, the first connector 406 can be a landing connector (e.g., for connection with a stair landing 404), and the second connector 408 can be a stair connector (e.g., for connection with stairs 402). However, in other embodiments, the first connector 406 can be a stair connector (e.g., for connection with stairs 402), and the second connector 408 can be a landing connector (e.g., for connection with a stair landing 404). The first connector 406 is operatively connected with the stair landing 404 or the stairs 402 via a nut and bolt connection, a welded connection, a pinned connection, or any other suitable connection means. The second connector 408 is operatively connected with the stairs 402 or the stair landing via a nut and bolt connection, a welded connection, a pinned connection, or any other suitable connection means. The first connector 406 and the second connector 408 are operatively connected by a third connector 410, with, for example, a first pin 412 operatively connecting a first end 416 of the third connector 410 with the first connector 406 and a second pin 414 operatively connecting a second end 418 of the third connector 410 with the second connector 408. The third connector 410 can have a fixed length; however, it is contemplated that, in some embodiments, the third connector 410 can have an adjustable length.

The operative connection of the first connector 406 with the third connector 410 and the second connector 408 with the third connector 410 allows the third connector 410 to swing as the stairs 402 move in tension and compression, perpendicularly away from and towards the stair landing 404. The second connector 408 can rotate to maintain the stairs 402 in a vertical orientation as the stairs 402 move horizontally away from the stair landing 404. As such, the stair system 400 is configured to allow the stairs 402 to move away from and/or towards the face 428 of the stair landing 404 as the stairs 402 rotate.

In some embodiments, the stair system 400 can further include a cover plate 420. In some embodiments, the cover plate 420 is operatively connected with the stair system 400 or portion thereof, while in other embodiments the cover plate 420 is operatively connected with the stairs 402, and in other embodiments the cover plate 420 is a separate system. In other embodiments, the cover plate 420 can be connected with a top tread of the stairs 402 thus rising and falling with any movement of the stairs 402. Furthermore, in some embodiments, the cover plate 420 is not connected to the stair landing 404. The cover plate 420 is configured to cover a gap 422 and/or the stair system 400 between the stairs 402 and any of a stair landing 404, ground, or other system. The cover plate 420 is therefore configured to slide in any lateral direction (e.g., forward/backward and/or side-to-side), raise, lower, and/or rotate with the stairs 402 as the stairs 402 move in order to provide a continuous, gap-less, path. The cover plate 420 can be, for example, a metal sheet or plate.

In some embodiments, and as shown in FIG. 4B, an alternate attachment bracket 422 can be utilized with the stair system 400. The alternate attachment bracket 422 is configured for allowing the stair system 400 to be mounted on a side 402A of the stairs 402 rather than behind, below, and/or underneath the stairs as shown in FIG. 4A. The alternate attachment bracket 422 can be bolted or welded to a stringer of the stairs 402. The configuration of the stair system 400 with the alternate attachment bracket 422 minimizes the nominal, at rest, joint width between the last riser 426 of the stairs 402 and the face 428 of the stair landing 404.

In another embodiment, and as shown in FIG. 4C, a pin connection system 430 can be utilized with the stair system 400. The pin connection system 430 includes a third pin 432, a pin mount 434, and a receiver 436. The pin mount 434 is coupled with the stair landing 404, the ground, or any other suitable connection point. The third pin 432 is coupled with the pin mount 434. In some embodiments, the third pin 432 can be a ball and the received can be a socket. The receiver 436 is coupled with the stairs 402, for example, on an underside 438 of the lowest run 440 of the stairs 402. The receiver 436 is configured to rest on the third pin 432. The third pin 432, therefore, is configured to allow the stairs 402 to rotate thereon (e.g., pivot forward and/or backward), thus mitigating any rising motion associated with the stair system 400.

The stair system 400 is configured to permit multiaxial movement of stairs 402 between building levels and/or landings. Testing has been performed and results indicate that the stair system 400 safely allows for multidirectional movement between about 0.1 inch and about 10 inches, such as between about 1 inch and about 5 inches. It is contemplated, however, that the movement capabilities of the stair system 400 are defined by each specific building requirements, project requirements, and/or required clearances. As such, the specific movement requirements for each stair system 400 are able to be altered to meet the requirements and clearances as detailed above.

Benefits of stair systems in accordance with the disclosed subject matter include that the stair system 400 provides multidirectional movement to absorb landing displacement without damage to the stair system 400. Additionally, the stair system 400 is easily disposed at the top or bottom of a flight of stairs, thus allowing all movement to be located at one point (e.g., an intermediate landing) as opposed to requiring each axis of movement to be located at opposite ends of the flight. As such, one end of the flight of stairs can remain fixed.

Figure 5A:
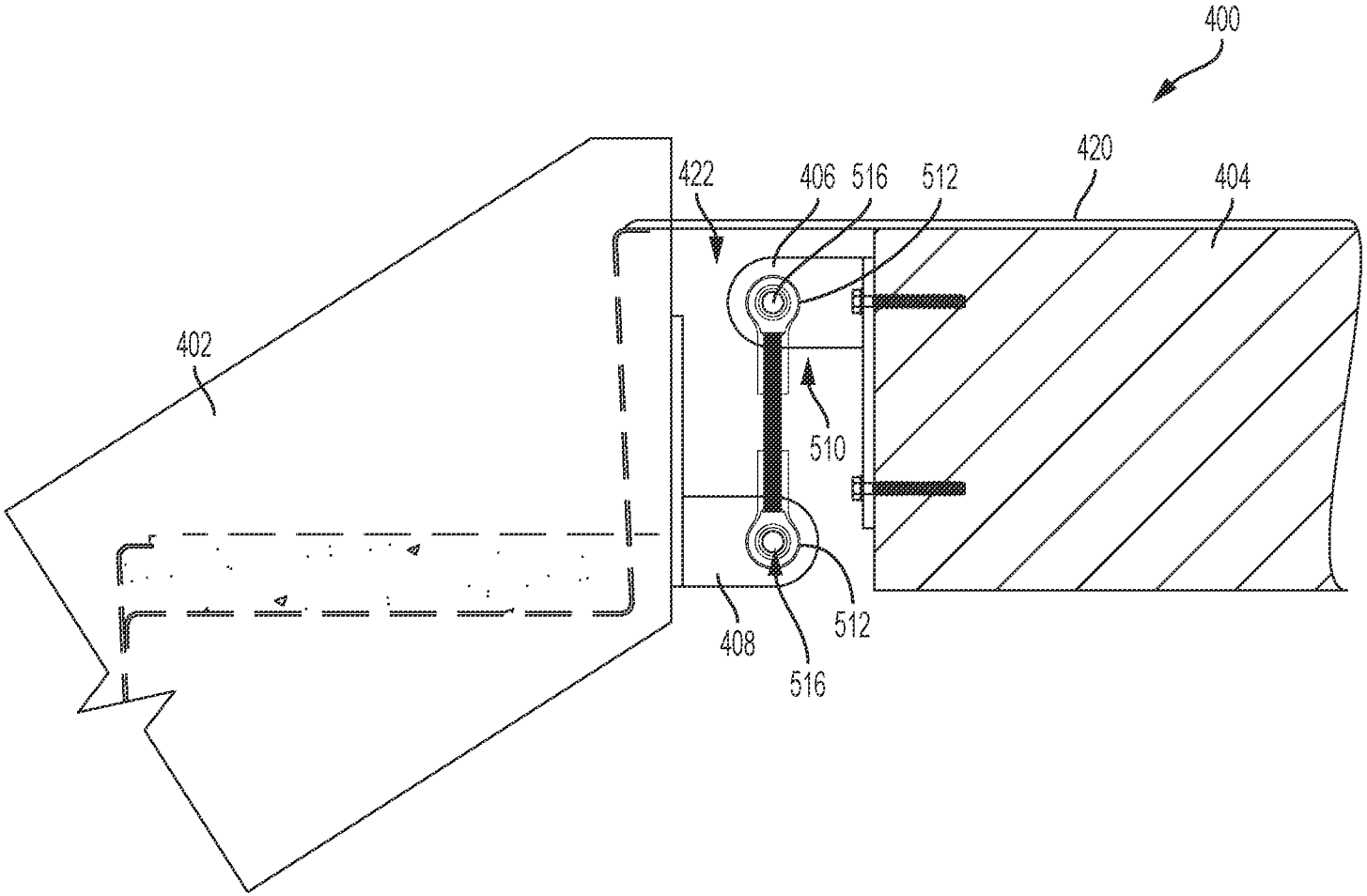
FIG. 5A schematically illustrates a side view of an alternative embodiment of the stair system of FIG. 4A, according to an example embodiment.
Figure 5B:
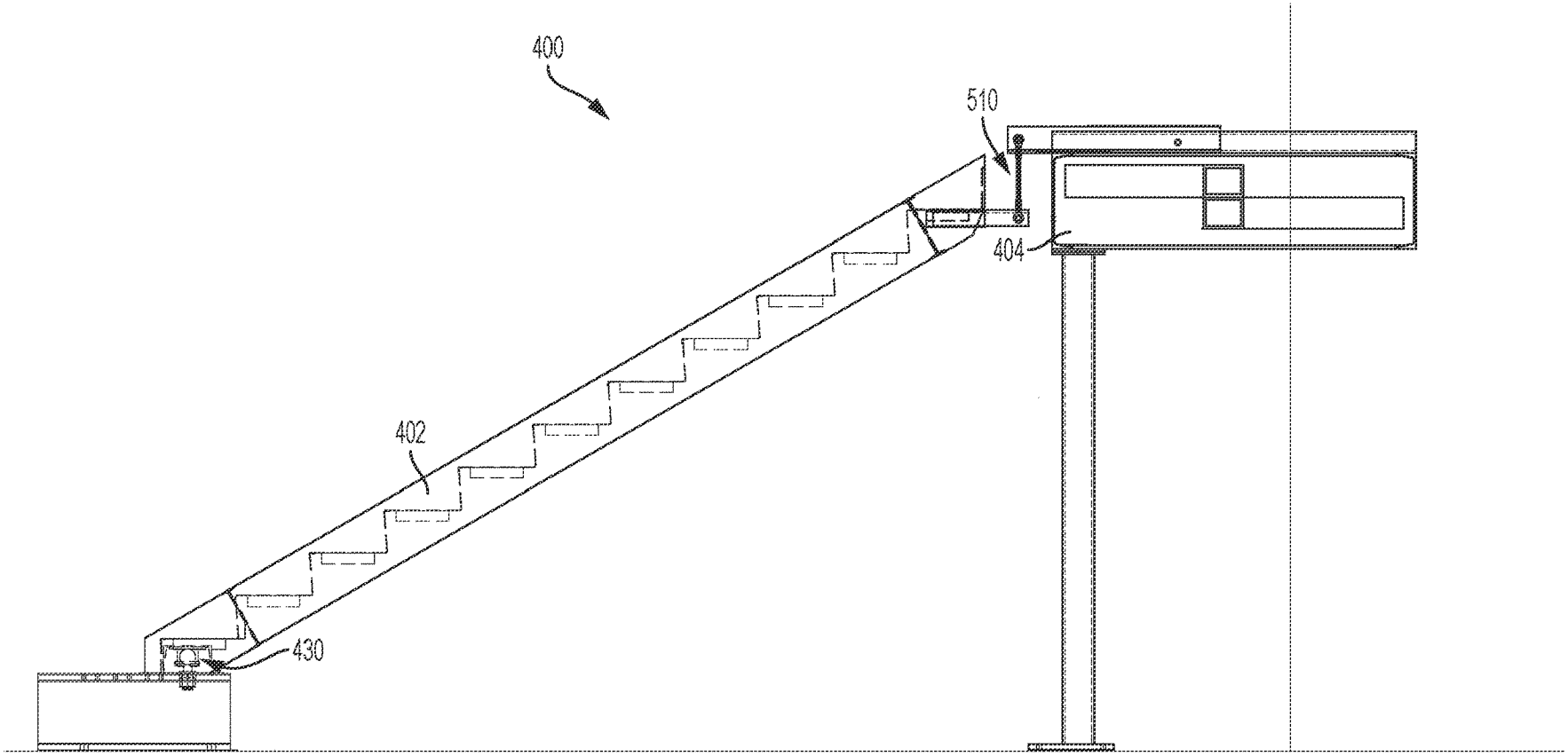
FIG. 5B schematically illustrates a side view of the stair system of FIG. 5A in combination with the pin connection system of FIG. 4C, according to an example embodiment.

For purpose of illustration and not limitation, FIGS. 5A-5B schematically illustrate alternative embodiments for stair system 400, shown in FIG. 4A, for allowing for movement of stairs 402 between building levels. For example, as shown in FIG. 5A, a ball-rod connector 510 can be utilized in place of the third connector 410 to operatively connect the first connector 406 with the second connector 408. The ball-rod connector 510 includes a first ball joint rod end 512, a second ball joint rod end 514, and a connecting rod 516. The first ball joint rod end 512 is operatively connected with the first connector 406 via a connecting bolt 516. The second ball joint rod end 514 is operatively connected with the second connector 408 via a connecting bolt 516. The first ball joint rod end 512 and the ball-rod connector 510 are configured to rotate around the first connector 406 to accommodate tension and compression movement. The second ball joint rod end 514 is configured to allow the stairs 402 to remain in a vertical orientation as the stair moves horizontally away from the stair landing 404. The second connector 408 projects the first ball joint rod end 512, the second ball joint rod end 514, and the ball-rod connector 510 into the gap 422 disposed between the stair landing 404 and the stairs 402, to allow both tension (e.g., movement away from the stair landing 404) and compression (e.g., movement toward the stair landing 404) movements. Furthermore, each of the first ball joint rod end 512 and the second ball joint rod end 514 are configured for rotation about the vertical axis of the ball rod connector 510 and the horizontal axis of the connecting bolts 516, thus enabling the stairs 402 to move laterally (e.g., left and right) in relation to the stair landing 404. The multiaxial rotation also provides additional allowance for orbital movements, for example, those typically associated with earthquake events.

Moreover, as shown in FIG. 5B, in some embodiments the pin connection system 430 of FIG. 4C can be utilized in combination with the embodiment including the ball-rod connector 510 of FIG. 5A. As shown in FIG. 5B, the ball rod connector 510 can be utilized in combination with stair system 400 at the stair landing 404 (e.g., a top stair landing) while the pin connection system 430 is utilized at the bottom of the stairs 402.

Figure 6A:
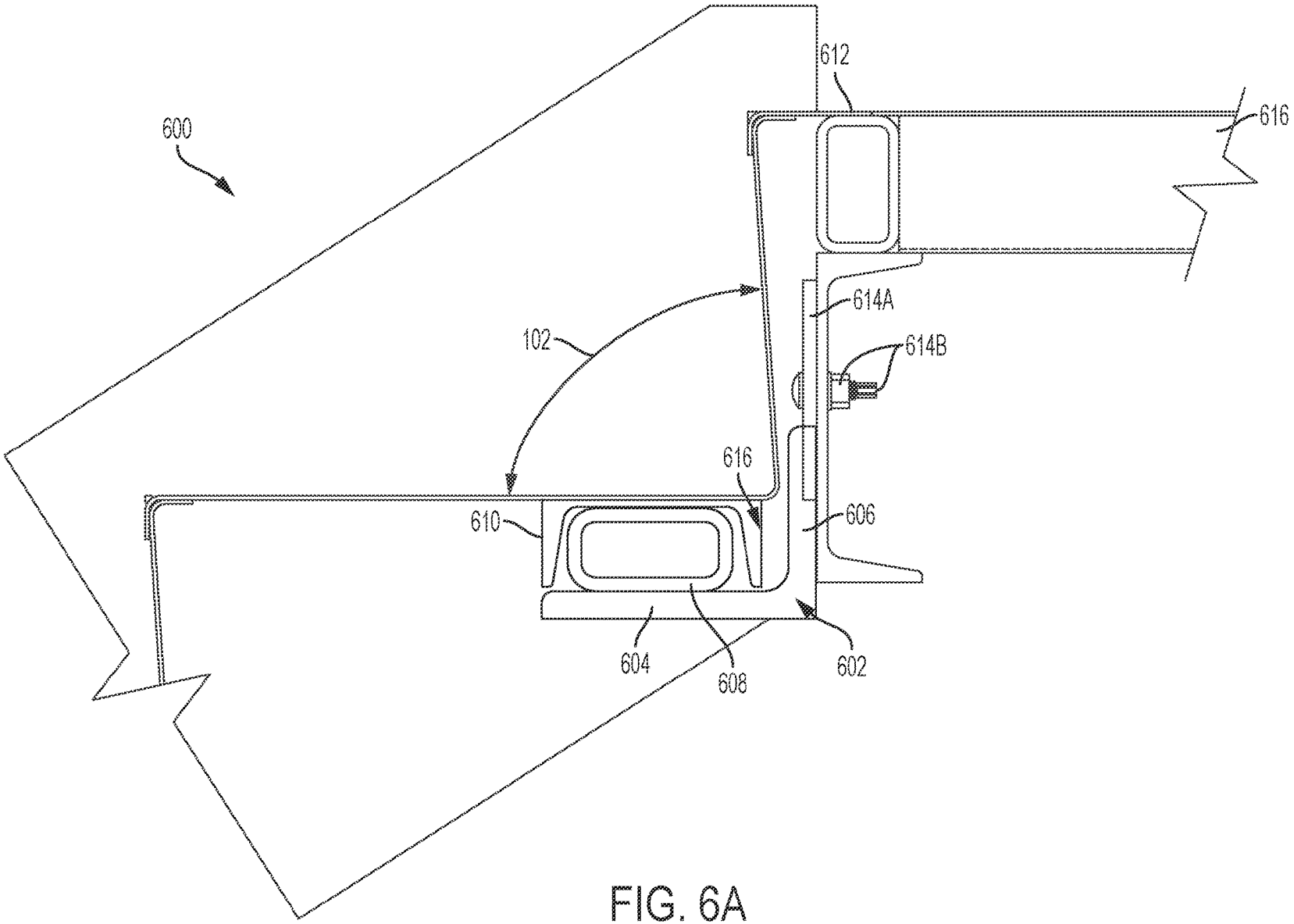
FIG. 6A schematically illustrates a side view of a retrofit system for allowing movement of pre-existing stairs between building levels, according to an example embodiment.
Figure 6B:
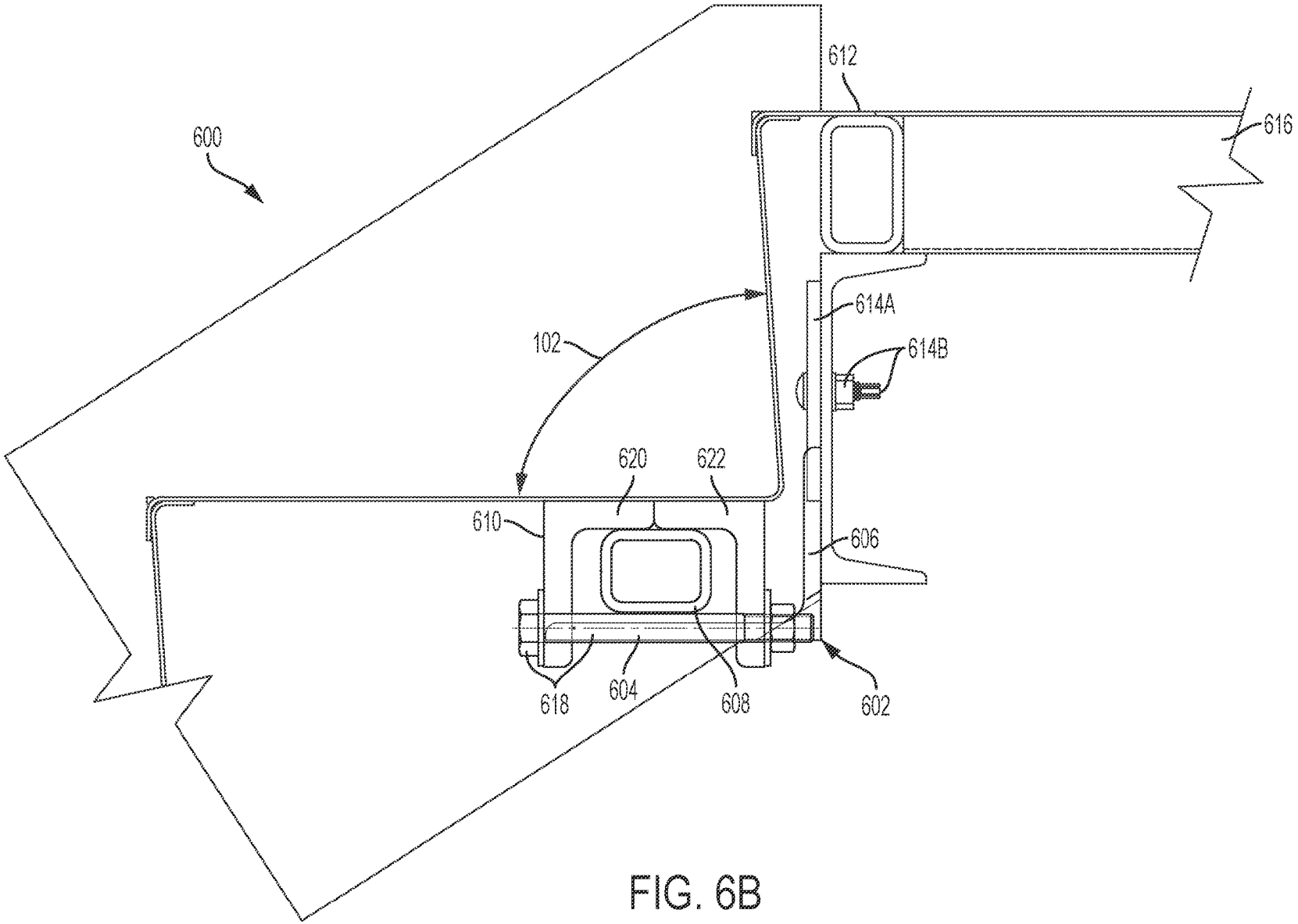
FIG. 6B schematically illustrates a side view of an alternative retrofit system for allowing movement of pre-existing stairs between building levels, according to an example embodiment.

For purpose of illustration and not limitation, FIGS. 6A and 6B schematically illustrate a retrofit system 600 for stairs for allowing movement of stairs 102 between building levels. As shown, the retrofit system 600 includes a support angle 602. The support angle 602 includes a horizontal panel 604 and a vertical panel 606. The support angle 602 is configured for connection to the landing 616. The support angle 602 can be coupled with the landing supports (not separately identified) via any suitable connection means, for example but not limited to, a mechanically fastened connection, a bolted connection, an extruded complete component, or a welded connection. Furthermore, the support angle 602 can be produced of any suitable material, for example, steel and/or aluminum. The stairs 102 can be a pre-existing set of stairs, a prefabricated set or stairs, or a new construction stair set.

The retrofit system 600 can also include a rail 608 and a bracket 610. The rail is disposed on the horizontal panel 604. In some embodiments, the rail 608 can be welded, bolted, and/or mechanically fastened to the support angle 602. The bracket 610 is configured for coupling with a tread 612 or the side stringer of the stairs, for example, an underside of the tread. The bracket 610 is configured to at least partially form fit over a top of the rail 608 such that the bracket 610 allows for sliding movement of the stairs 102 as guided by the rail 608. In some embodiments, the bracket 610 can include a first member 620 and a second member 622 that together form a U-shape, as shown in FIG. 6B. The bracket 610 includes a channel which can be connected with and/or between the stringers or the stairs 102. The bracket 610 is configured to slide over the rail 608

In some embodiments, as also shown in FIG. 6B, a positive connection assembly 618 is fastened through the bracket 610 and under the rail 608. The positive connection assembly 618 securely attaches the retrofit system 600 to the landing 616, the ground, and/or the stairs 102. In some embodiments, the positive connection assembly 618 includes a nut and bolt assembly, although other suitable positive connection assemblies are contemplated. The positive connection assembly 618 ensures that the stairs 102 will not disengage from the landing 616 should vertical movement occur.

Additionally, in some embodiments, the retrofit system 600 can include a top tread 612 of a stair. The top tread 612 is configured for disposal between the landing 616 and the stairs 102. As such, the top tread 612 visually obstructs the support angle 602.

Retrofit systems in accordance with the disclosed subject matter, including the retrofit system 600, allow for movement of the stairs 102 in the lateral direction. In order to retrofit an existing set of stairs 102 and/or landing 616 to allow for movement, the uppermost stair tread is removed and a typical non-retro-fitted connection, including a plate 614A and bolt 614B, are also removed. While the stringers are supported the support angle 602 and the rail 608 are each operatively connected to the existing landing channel 616 and the bracket 610 is coupled with a tread of the existing staircase. Top tread 612 is operatively connected with the retrofit system 600 to replace the previously removed uppermost tread. The top tread 612 is configured to cover any gaps disposed between the stairs 102 and the landing 616 such that a continuous surface is provided during all movement scenarios.

Exemplary benefits of retrofit systems in accordance with the disclosed subject matter include a reduction in the amount of space required for the overall installation, and protection/salvage of the existing stair system. Additionally, the retrofit system 600 provides for an installation process that is simplified, thus resulting in cost reductions.

For purpose of illustration and not limitation, FIGS. 7A-7D schematically illustrate a stair system 700 for allowing for movement of stairs 102 between building levels. As shown, the stair system 700 includes a first movement system 710 and a second movement system 730.

Figure 7A:
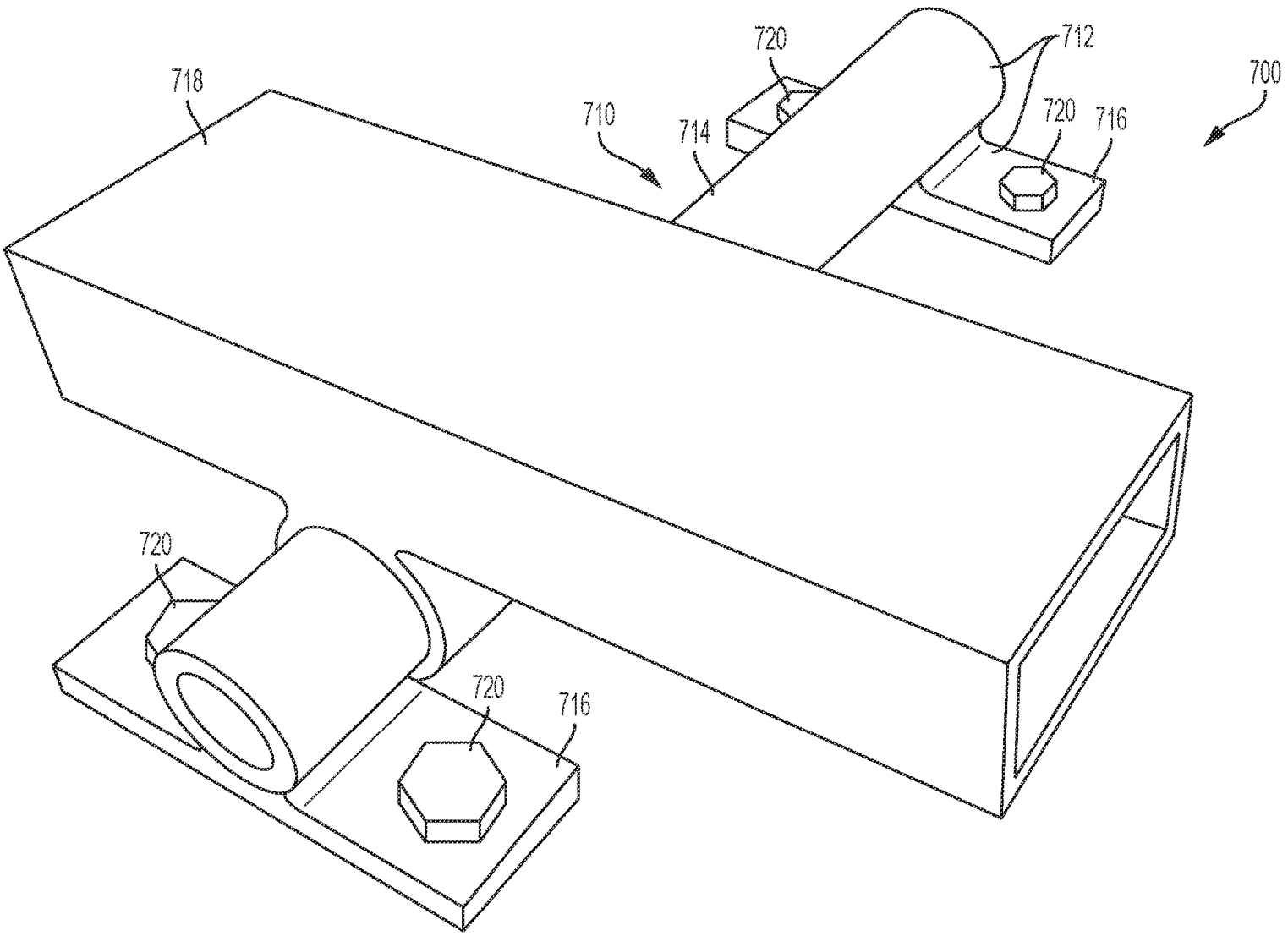
FIGS. 7A and 7B schematically illustrate perspective views of a movement system of a stair system for allowing for movement of stairs between building levels, according to an example embodiment.
Figure 7B:
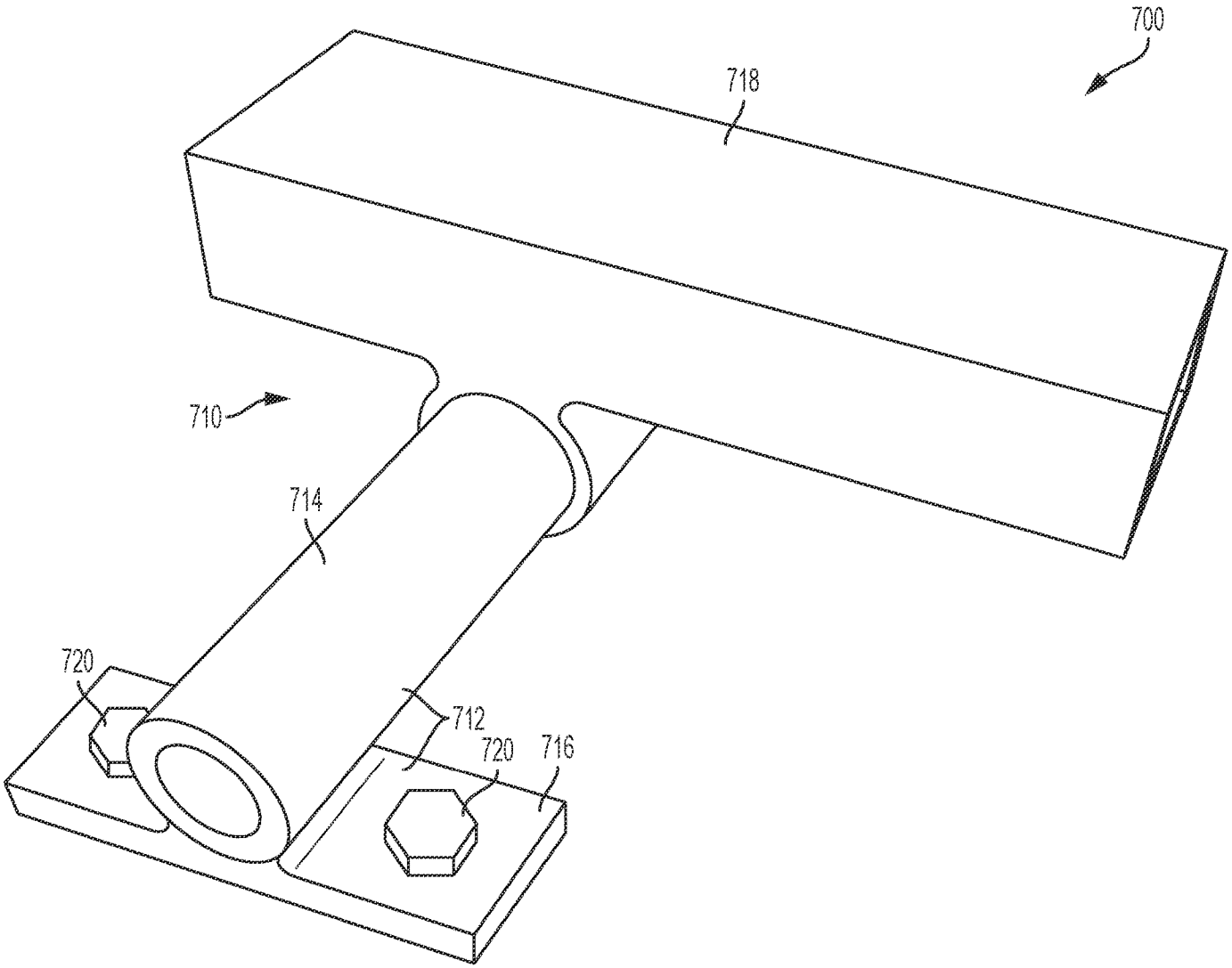

In some embodiments, as shown in FIGS. 7A and 7B, the first movement system 710 includes a first landing connector 712. The first landing connector 712 includes a first guide rail 714 and at least one first foot 716. The at least one first foot 716 is coupled with the first guide rail 714.

The first movement system 710 can also include a first support beam 718. The first support beam 718 is operatively coupled with the first guide rail 714, such that the first support beam 718 slides along the first guide rail 714. The first support beam 718 can be constructed from any suitable material for supporting stairs, and as shown, can be hollow or solid, or any combination thereof. Suitable materials can include, for example, metal (e.g., aluminum), plastics, and/or glass. The first support beam 718 can be square-shaped, rectangular, L-shaped, double-L shaped, or any other suitable shape.

In some embodiments, the first movement system 710 further includes a first connection system 720. The first connection system 720 is configured to couple the at least one first foot 716 with at least one of a first stair, a first landing, or a first ground location.

Figure 7C:
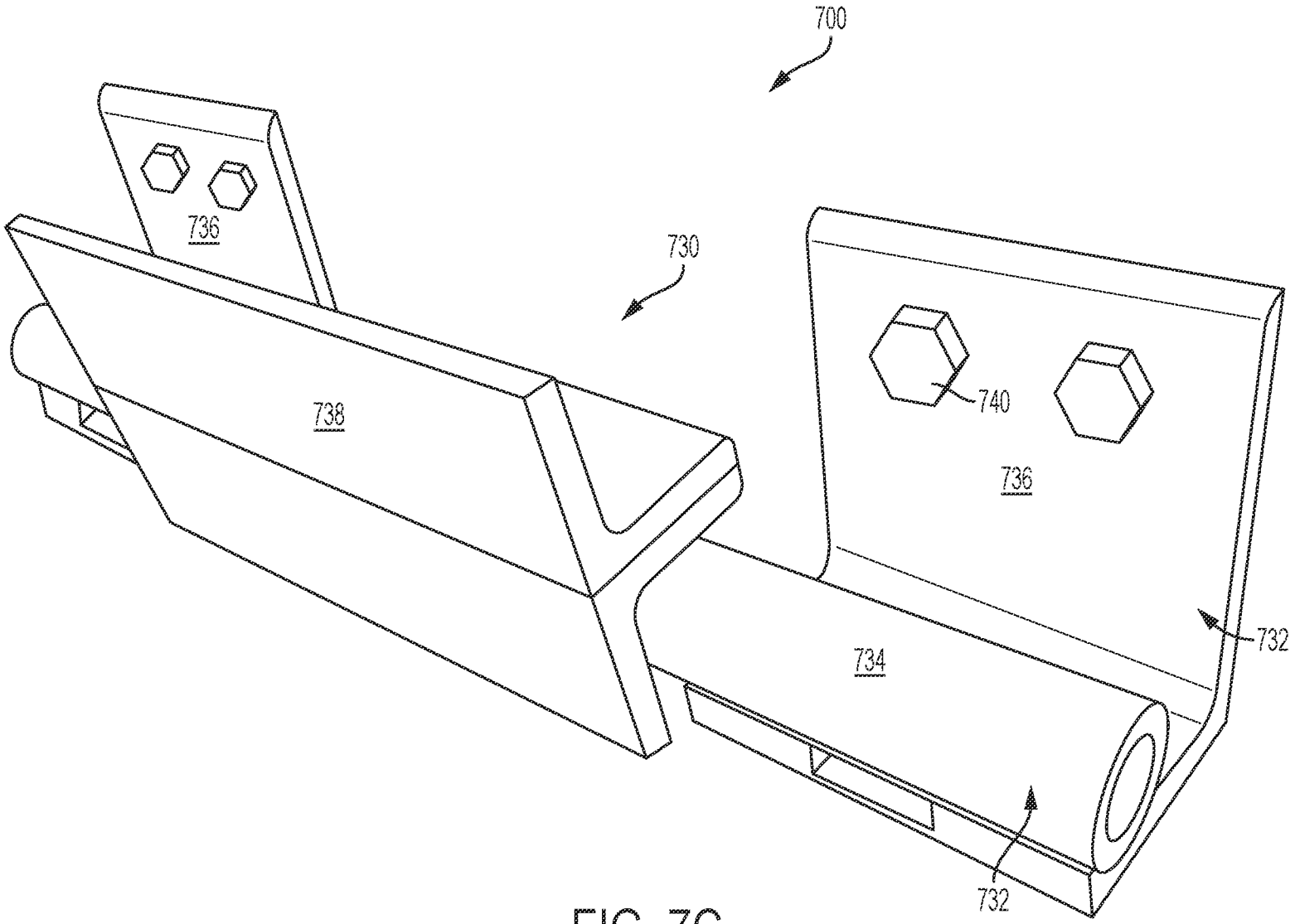
FIGS. 7C and 7D schematically illustrate perspective views of an alternative movement system of a stair system for allowing movement of stair between building levels, according to an example embodiment.
Figure 7D:
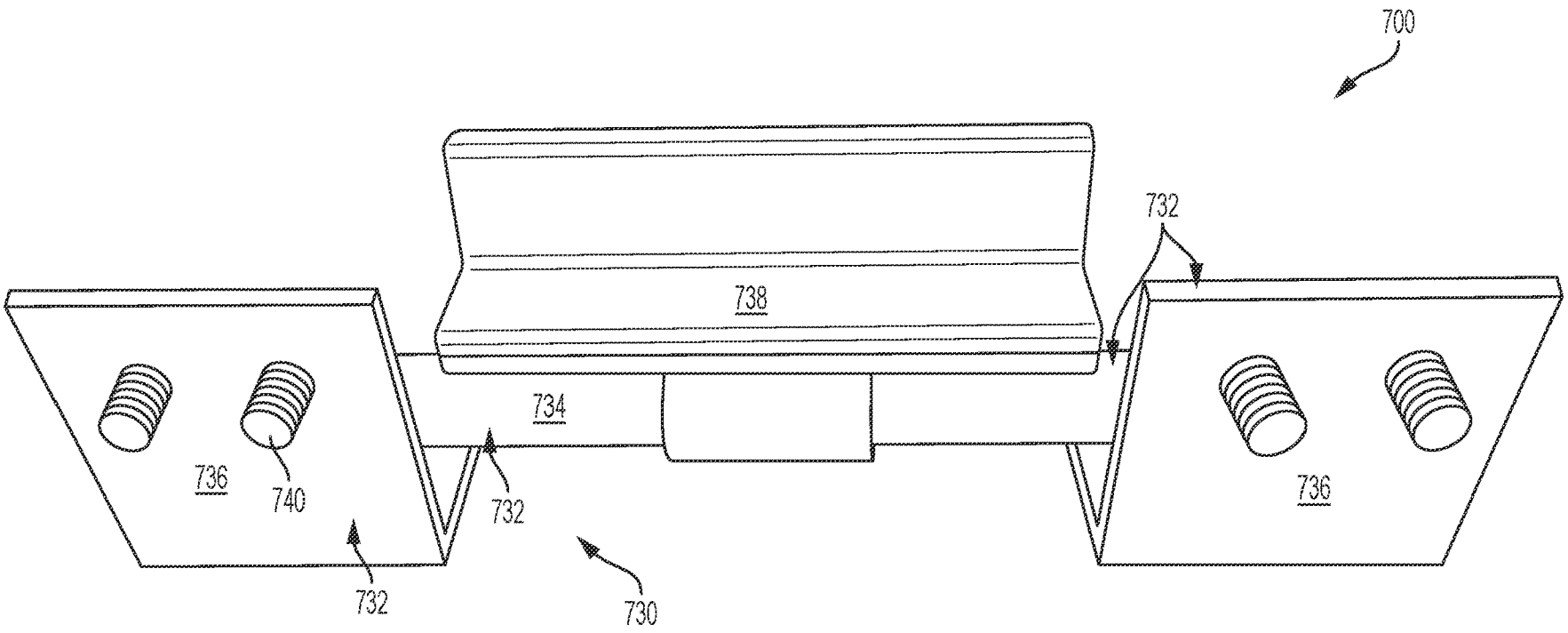

In some embodiments, as shown in FIGS. 7C and 7D, the second movement system 730 includes a second landing connector 732. The second landing connector 732 includes a second guide rail 734 and at least one second foot 736. The at least one second foot 736 is coupled with the second guide rail 734.

The second movement system 730 can also include a second support beam 738. The second support beam 738 is operatively coupled with the second guide rail 734, such that the second support beam 738 slides along the second guide rail 734. The second support beam 738 can be constructed from any suitable material for supporting stairs, and as shown, can be hollow or solid, or any combination thereof. The second support beam 738 can be square-shaped, rectangular, L-shaped, double-L shaped, or any other suitable shape.

In some embodiments, the second movement system 730 further includes a second connection system 740. The second connection system 740 is configured to couple the at least one second foot 736 with at least one of a second stair, a second landing, or a second ground location.

Figure 7E:
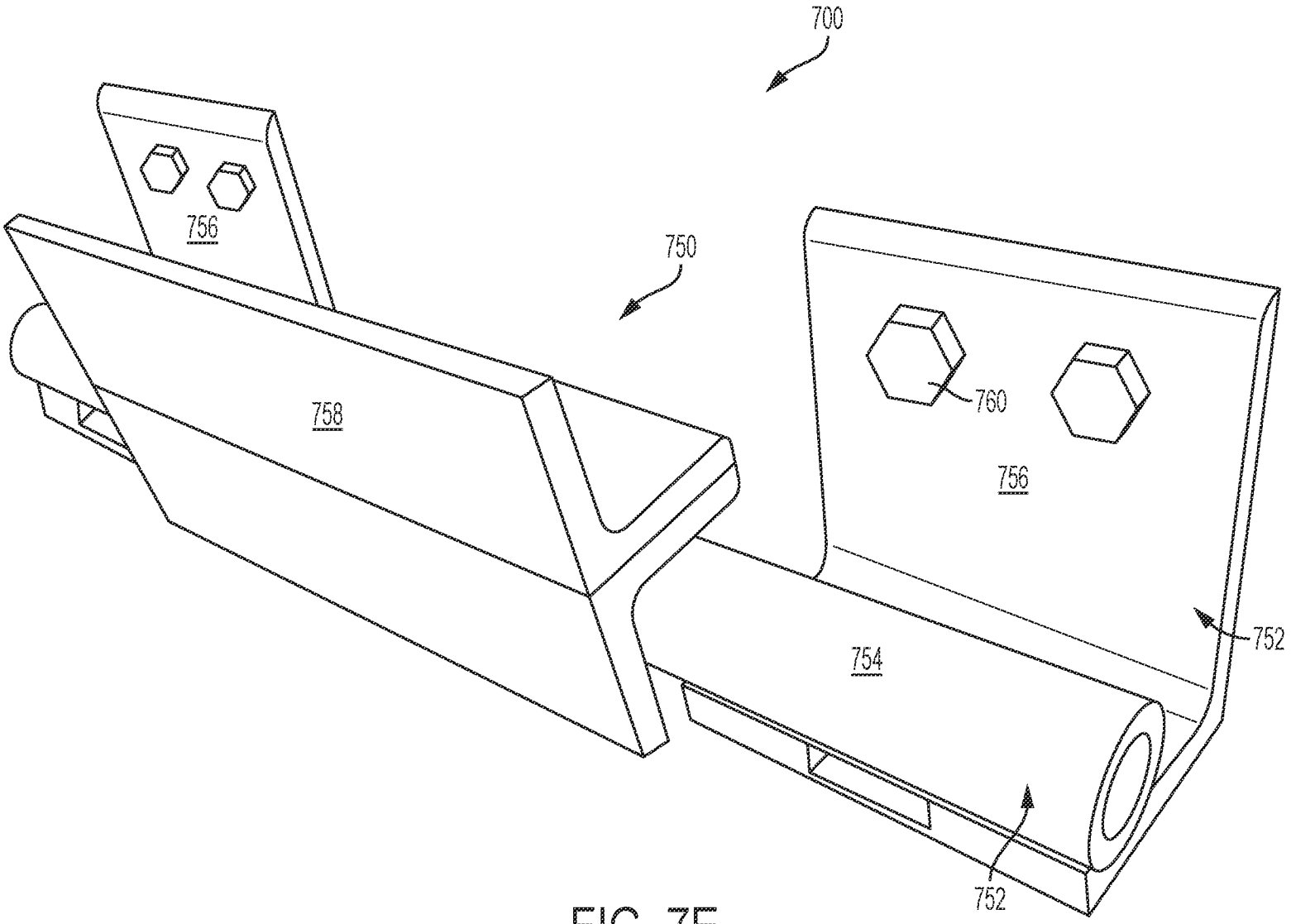
FIGS. 7E and 7F schematically illustrate perspective views of another movement system of a stair system for allowing for movement of stairs between building levels, according to an example embodiment.
Figure 7F:
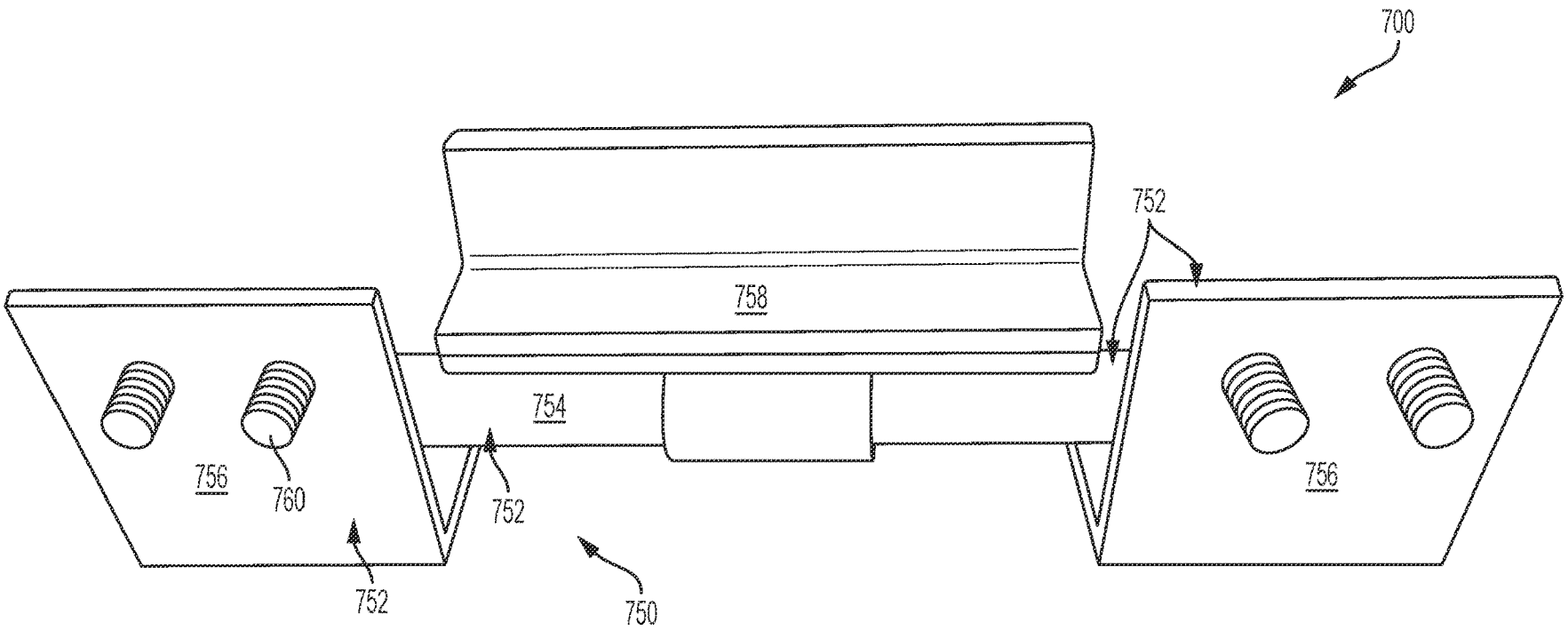
Figure 7G:
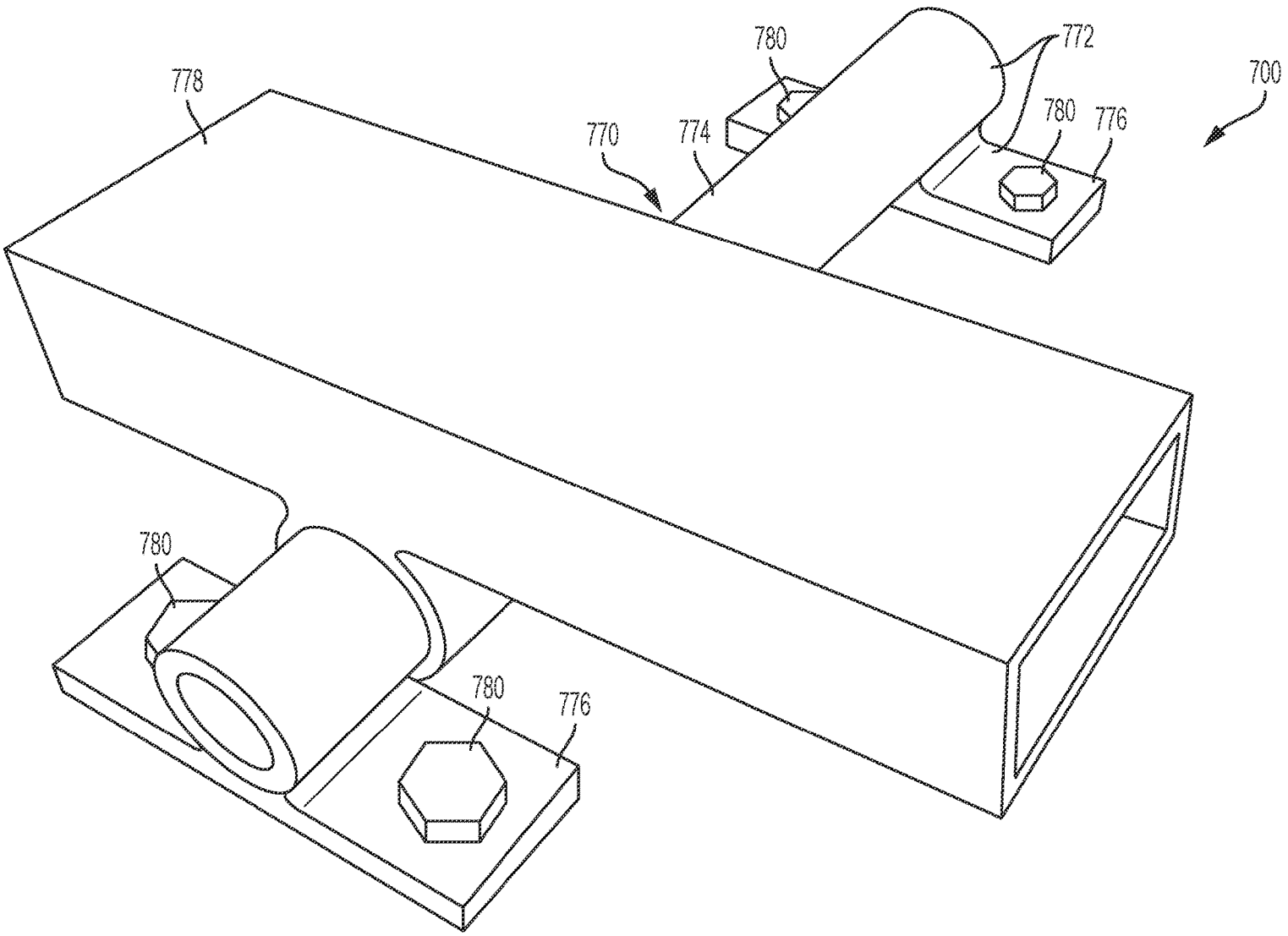
FIGS. 7G and 7H schematically illustrate perspective views of another movement system of a stair system for allowing movement of stair between building levels, according to an example embodiment.
Figure 7H:
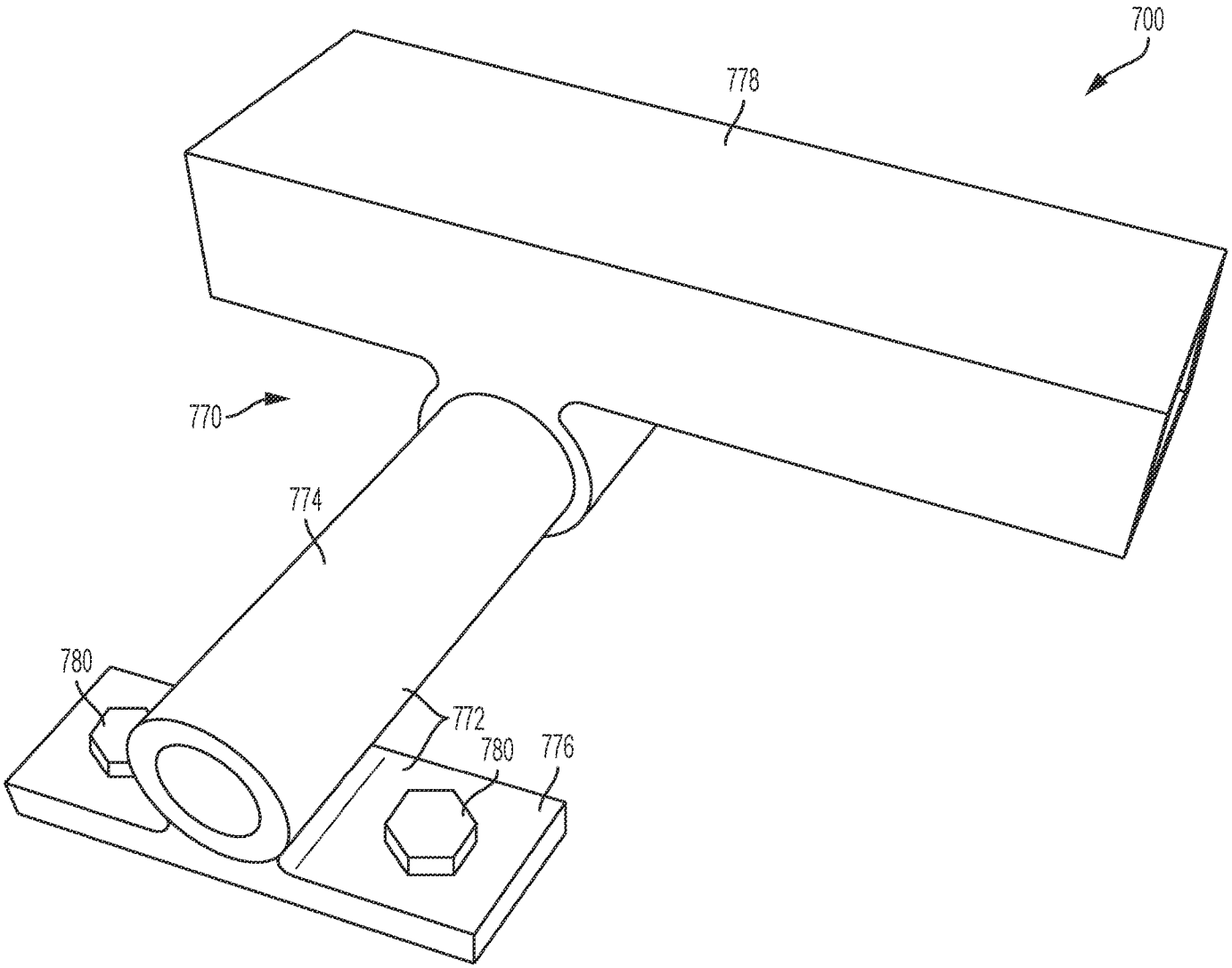
Figure 71:
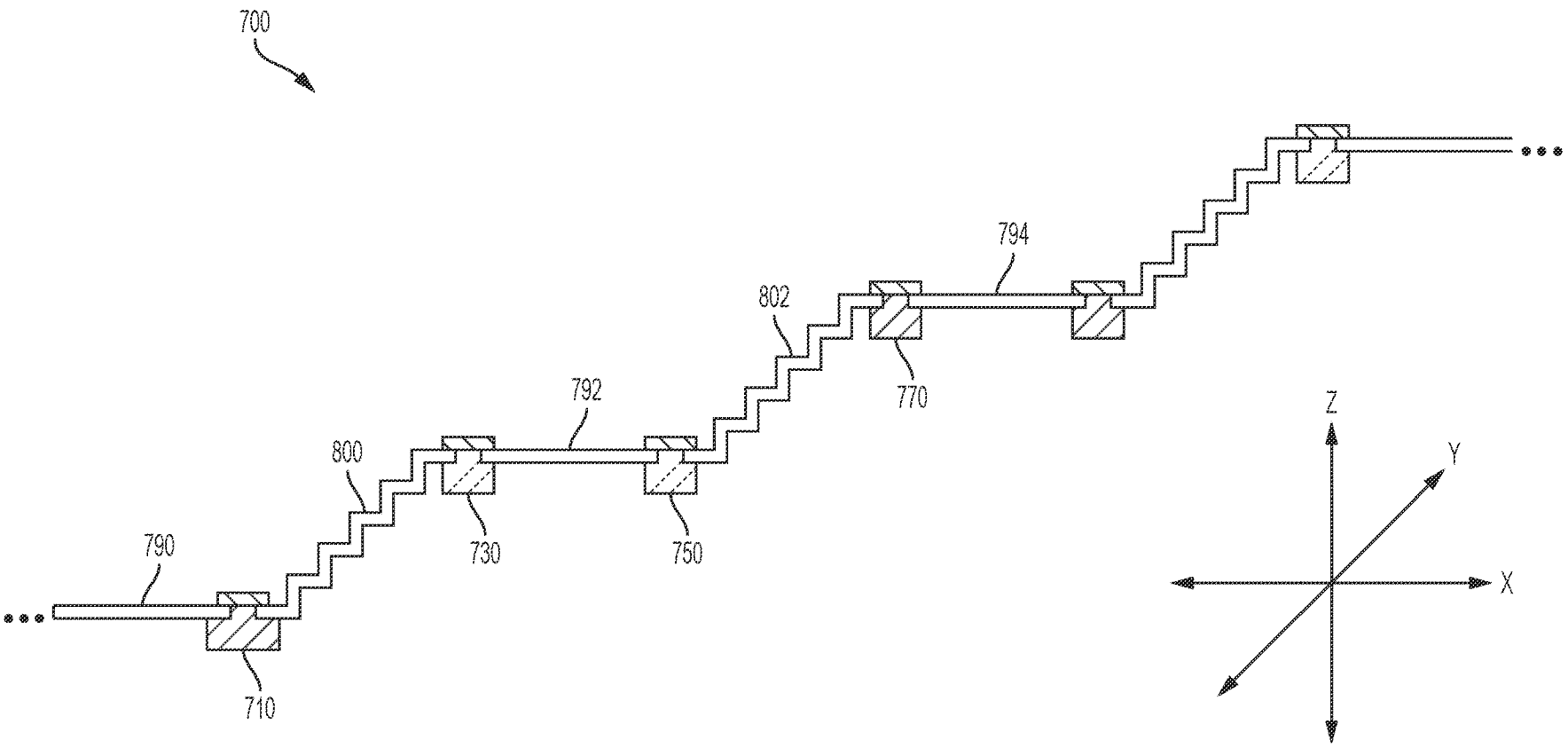
Figure 7J:
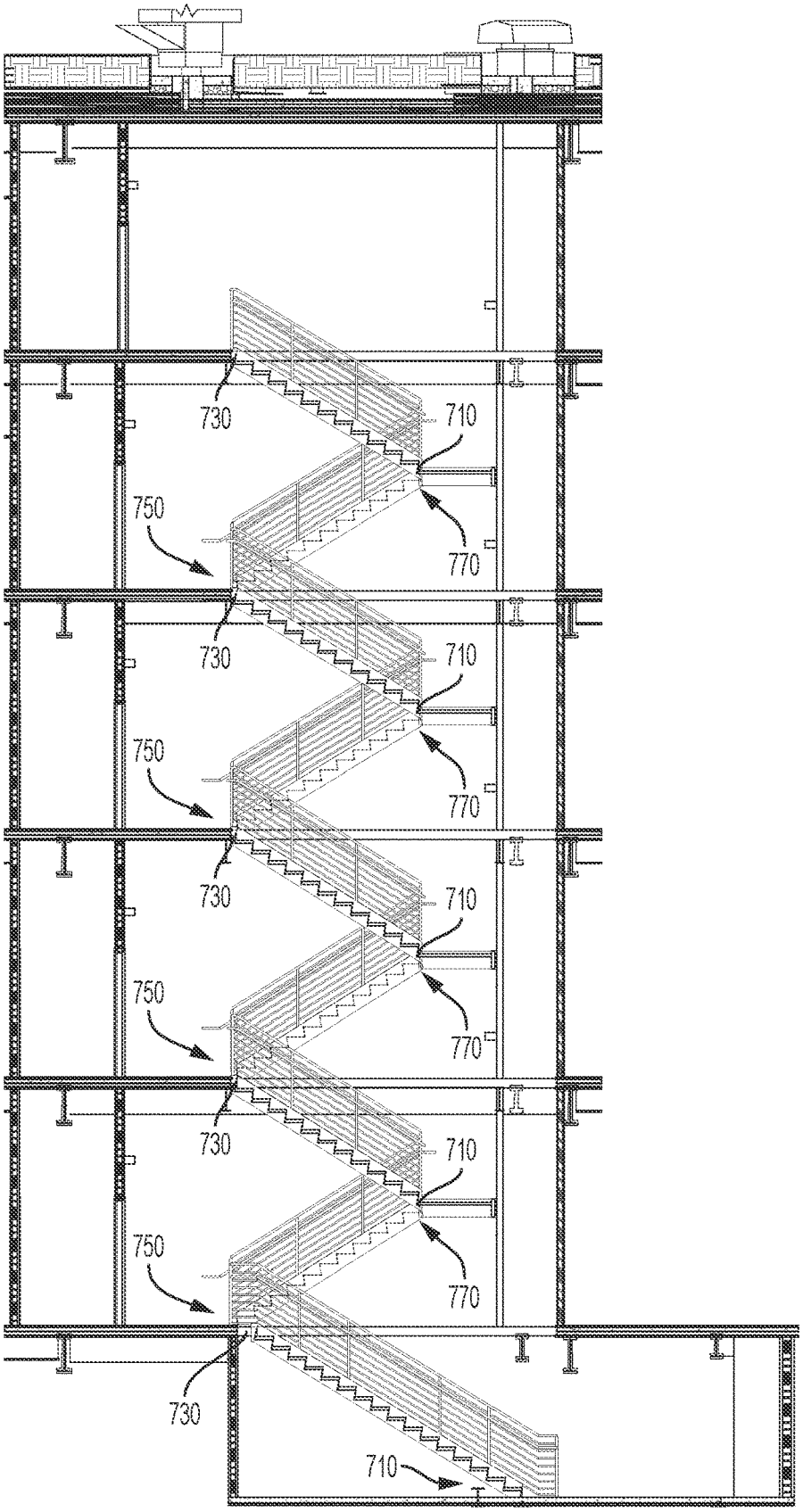
FIG. 7J schematically illustrates an exemplary installation of multiple stair systems of any one of FIGS. 7A-7H, according to an example embodiment.

As shown in FIGS. 7I and 7J for illustration and not limitation, the first movement system 710 allows for movement in a first direction X, while the second movement system 730 allows for movement in a second direction Y. The first direction X and the second direction Y can be in different axes to allow for multiaxial movement. In some embodiments, the second direction Y is approximately perpendicular to the first direction X. In some embodiments, the first movement system 710 is configured for coupling with a first landing 790 (e.g., bottom landing) of a first stair set 800 and the second movement system 730 is configured for coupling with a second landing 792 (e.g., top landing) of the first stair set 800. It is contemplated that, in some embodiments, any of the first movement system 710 and/or the second movement system 730 can be configured for coupling with either the first landing 790 of the first stair set 800 and/or the second landing 792 of the first stair set 800. However, in some embodiments, the first movement system 710 is configured for coupling at one of the first landing 790 or the second landing 792 of the first stair set 800, while the second movement system 730 is configured for coupling at one of the first landing 790 or the second landing 792 of the first stair set, whichever is not coupled with the first movement system 710, such that the first movement system 710 and the second movement system 730 are utilized in conjunction on the first stair set 800 in order to realize maximum movement of the stairs. Although the first movement system 710 and the second movement system 730 are described as configured for coupling with either the first landing 790 and/or the second landing 792, supra, it is contemplated that the any of the first movement system 710 and/or the second movement system 730 can be configured for coupling with a landing, stairs, a ground, or any other suitable system.

As further shown in FIGS. 7E-7J, in some embodiments, including those in which multiple sets of stairs are disposed (e.g., a stairwell), the stair system 700 can further include a third movement system 750 and a fourth movement system 770. The third movement system 750 is substantially similar to the second movement system 730, and the fourth movement system 770 is substantially similar to the first movement system 710.

Referring to FIGS. 7E and 7F for purpose of illustration and not limitation, the third movement system 750 includes a third landing connector 752. The third landing connector 752 includes a third guide rail 754 and at least one third foot 756. The at least one third foot 756 is coupled with the third guide rail 754.

The third movement system 750 can also include a third support beam 758. The third support beam 758 is operatively coupled with the third guide rail 754, such that the third support beam 758 slides along the third guide rail 754.

In some embodiments, the third movement system 750 further includes a third connection system 760. The third connection system 760 is configured to couple the at least one third foot 756 with at least one of a third stair, a third landing, or a third ground location.

Referring to FIGS. 7G and 7H for illustration and not limitation, the fourth movement system 770 includes a fourth landing connector 772. The fourth landing connector 772 includes a fourth guide rail 774 and at least one fourth foot 776. The at least one fourth foot 776 is coupled with the fourth guide rail 774.

The fourth movement system 770 can also include a fourth support beam 778. The fourth support beam 778 is operatively coupled with the fourth guide rail 774, such that the fourth support beam 778 slides along the fourth guide rail 774.

In some embodiments, the fourth movement system 770 further includes a fourth connection system 780. The fourth connection system 780 is configured to couple the at least one fourth foot 776 with at least one of a fourth stair, a fourth landing, or a fourth ground location.

Referring again to FIGS. 7I and 7J for illustration and not limitation, the third movement system 750 allows for movement in the second direction Y, while the fourth movement system 770 allows for movement in the first direction X. In some embodiments, the third movement system 750 is configured for coupling with the second landing 792 of the first stair set 800 and the fourth movement system 770 is configured for coupling with a third landing 794 of a second stair set 802. Although the third movement system 750 and the fourth movement system 770 are described as configured for coupling with either the second landing 792 of the first stair set 800 and/or the third landing 794 of the second stair set 802, supra, it is contemplated that the any of the third movement system 750 and/or the fourth movement system 770 can be configured for coupling with a landing, stairs, a ground, or any other suitable system.

Utilization of the first movement system 710 at the first landing 790 (e.g., bottom) of the first stair set 800 and the second movement system 730 at the second landing 792 (e.g., top) of the first stair set 800, allows the first stair set 800 to move in both a tension and a compression direction. Likewise, the utilization of the third movement system 750 at the second landing 792 of the first stair set 800 and the fourth movement system 770 at the third landing 794 of the second stair set 802, allows the second stair set 802 to move in both a tension and a compression direction.

In some embodiments, it is contemplated that lubricants can be utilized with the stair system 700 disclosed, however, testing has been performed and results indicate that the frictional forces between the parts of the stair system 700 provide a resistance that is sufficiently overcome during actions which require stair movement without lubricants.

Figure 7K:
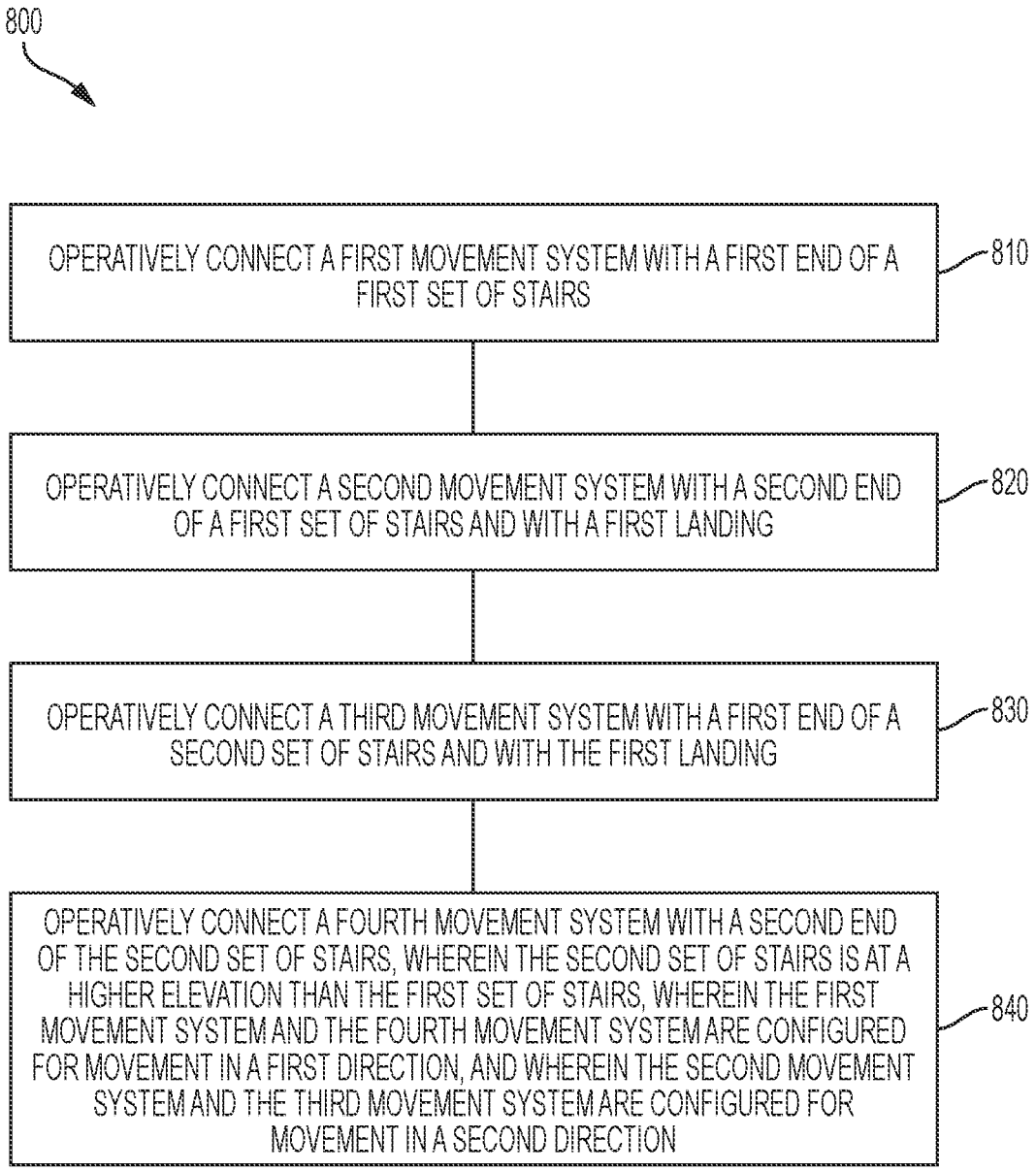
FIG. 7K schematically illustrates operations of a method for installing a stair system, according to an example embodiment.

For purpose of illustration and not limitation, FIG. 7K schematically illustrates operations of a method 800 for installing a stair system, such as stair system 700. At operation 810, a first movement system is operatively connected to a first end of a first set of stairs. At operation 820, a second movement system is operatively connected to a second end of the first set of stairs. The first end of the first set of stairs is disposed adjacent a lower-most stair of the first set of stairs, and the second end of the first set of stairs is disposed adjacent an upper-most stair of the first set of stairs. As such, the first movement system is configured for coupling with a bottom landing of the first set of stairs and the second movement system is configured for coupling with a top landing of the first set of stairs. The first movement system allows for movement in a first direction, and the second movement system allows for movement in a second direction, wherein the second direction is different than the first direction. At operation 830, a third movement system is operatively connected to a first end of a second set of stairs. At operation 840, a fourth movement system is operatively connected to a second end of the second set of stairs. The first end of the second set of stairs is disposed adjacent a lower-most stair of the second set of stairs, and the second end of the second set of stairs is disposed adjacent an upper-most stair of the second set of stairs. As such, the third movement system is configured for coupling with a bottom landing of the of the second set of stairs and the fourth movement system is configured for coupling with a top landing of the second set of stairs. The third movement system allows for movement in the second direction, and the fourth movement system allows for movement in the first direction. As such, the first movement system and the fourth movement system are substantially similar in that each are operatively connected with the same landing and allow for movement in the same direction. Furthermore, the second movement system and the third movement system are substantially similar in that each are operatively connected with the same landing and allow for movement in the same direction.

The present disclosure is not limited to the specific combinations of the embodiments disclosed as it is contemplated that any number of the disclosed embodiments can be combined to allow for additional stair movement. The stair systems and methods disclosed allow for stair movement between building levels, platforms, landings, or the like while maintaining the structural integrity of the stair system for safe egress passage. The systems and methods disclosed further allow for independent movement of the surrounding building walls, landings, floor slabs, and/or any other portion of the surrounding building structure to the stair system. The embodiments of the present disclosure are suitable for use in both new constructions as well as in existing constructions for retrofit applications to allow for movement between levels, landings, or within stairwell structures. The present disclosure can reduce stair damage during building movement whether it is from wind, thermal, or seismic activity, and/or any other type of suitable force or experience, as the present disclosure allows for directional movement, or a combination thereof, including tension and compression, lateral, or vertical movement.

While the foregoing is directed to embodiments described herein, other and further embodiments can be devised without departing from the basic scope thereof, and the scope thereof is determined by the claims that follow.

What is claimed is:

1. A retrofit system for stairs, comprising:

a support angle comprised of a horizontal panel and a vertical panel, wherein the support angle is removably connected to the stairs;

a rail disposed on the horizontal panel; and a bracket coupled with a tread of the stairs, wherein the bracket is at least partially form fitted over a top of the rail such that the bracket is configured to slide along the rail thereby permitting sliding movement of the stairs as guided by the rail.

2. The retrofit system of claim 1, further comprising a positive connection assembly fastened through the bracket and under the rail.

3. The retrofit system of claim 1, wherein the positive connection assembly comprises a nut and bolt assembly.

4. The retrofit system of claim 1, wherein the bracket comprises a first member and a second member that together form a U-shape.

5. The retrofit system of claim 1, wherein the support angle is connected to the stairs with a mechanically fastened connection, a bolted connection, an extruded complete component, or a welded connection.

6. The retrofit system of claim 1, wherein the support angle comprises steel, aluminum, or another metal.

7. The retrofit system of claim 1, wherein the bracket is further configured for coupling with a side stringer of the stairs.

8. The retrofit system of claim 1, further comprising a top tread configured for disposal between a landing and the stairs to visually obstruct the support angle.

9. The retrofit system of claim 8, wherein the top tread is configured to cover one or more gaps disposed between the stairs and the landing such that a continuous surface is created.

10. The retrofit system of claim 1, further comprising a cover plate configured to cover at least one of a gap or the stair system between the stairs and a landing.

11. The retrofit system of claim 10, wherein the cover plate is further configured to move in any lateral direction in order to provide a continuous, gap-less path.

12. The retrofit system of claim 10, wherein the cover plate comprises a metal sheet or a metal plate.

13. A stair system, comprising:

a first movement system, comprising:

a first landing connector comprising a first guide rail and at least one first foot coupled with the first guide rail;

a first support beam operatively coupled with the first guide rail, such that the first support beam slides along the first guide rail; and a first connection system configured for coupling the at least one first foot with at least one of a first stair, a first landing of a first stair set, or a first ground location;

a second movement system, comprising:

a second landing connector comprising a second guide rail and at least one second foot coupled with the second guide rail;

a second support beam operatively coupled with the second guide rail, such that the second support beam slides along the second guide rail; and a second connection system configured for coupling the at least one second foot with at least one of a second stair, a second landing of the first stair set, or a second ground location;

wherein the first movement system is configured to allow movement in a first direction, wherein the second movement system is configured to allow movement in a second direction different to the first direction, wherein the first movement system is configured for coupling with a bottom landing of the first stair set and the second movement system is configured for coupling with a top landing of the first stair set.

14. The stair system of claim 13, wherein the first support beam or the second support beam comprises at least one of a metal, a plastic, or a glass.

15. The stair system of claim 13, wherein the first support beam or the second support beam comprises a square shape, a rectangular shape, an L-shape, or a double-L-shape.

16. The stair system of claim 13, further comprising a lubricant adapted to be utilized with the stair system.

17. The stair system of claim 13, wherein the first stair set is configured to move in both a tension direction and a compression direction.

18. The stair system of claim 13, wherein the second direction is perpendicular to the first direction.

19. The stair system of claim 13, further comprising:

a third movement system, comprising:

a third landing connector comprising a third guide rail and at least one third foot coupled with the third guide rail;

a third support beam operatively coupled with the third guide rail, such that the third support beam slides along the third guide rail; and a third connection system configured for coupling the at least one third foot with at least one of a third stair, the second landing of the first stair set, a third landing of a second stair set, or a third ground location;

a fourth movement system, comprising:

a fourth landing connector comprising a fourth guide rail and at least one fourth foot coupled with the fourth guide rail;

a fourth support beam operatively coupled with the fourth guide rail, such that the fourth support beam slides along the fourth guide rail; and a fourth connection system configured for coupling the at least one fourth foot with at least one of a fourth stair, a fourth landing of the second stair set, or a fourth ground location;

wherein the third movement system is configured to allow movement in the second direction, wherein the fourth movement system is configured to allow movement in the first direction, wherein the third movement system is configured for coupling with the top landing of the first stair set and the fourth movement system is configured for coupling with a top landing of the second stair set.

20. The stair system of claim 19, wherein the second stair set is configured to move in both a tension direction and a compression direction.

* * * * *